US011226112B2

(12) United States Patent
Ukibune et al.

(10) Patent No.: US 11,226,112 B2
(45) Date of Patent: Jan. 18, 2022

(54) AIR-CONDITIONING SYSTEM

(71) Applicant: DAIKIN INDUSTRIES, LTD., Osaka (JP)

(72) Inventors: Masanori Ukibune, Osaka (JP); Kouichi Yasuo, Osaka (JP); Masao Ohno, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/190,229

(22) Filed: Mar. 2, 2021

(65) Prior Publication Data

US 2021/0180802 A1 Jun. 17, 2021

Related U.S. Application Data

(63) Continuation of application No. PCT/JP2019/037656, filed on Sep. 25, 2019.

(30) Foreign Application Priority Data

Sep. 28, 2018 (JP) ..... JP2018-184275

(51) Int. Cl.
*F24F 1/0068* (2019.01)
*F24F 11/83* (2018.01)

(52) U.S. Cl.
CPC ..... *F24F 1/0068* (2019.02); *F24F 11/83* (2018.01)

(58) Field of Classification Search
CPC ..... F24F 11/83; F24F 1/0068; F24F 11/875; F24F 2005/0025; F24F 5/0017
See application file for complete search history.

(56) References Cited

FOREIGN PATENT DOCUMENTS

| | | | | |
|---|---|---|---|---|
| CN | 104236177 A | | 12/2014 | |
| JP | 3-28672 A | | 2/1991 | |
| JP | H0328672 A | * | 4/1991 | ..... F24H 1/183 |
| JP | H11-294886 A | | 10/1999 | |
| JP | 2001-248925 A | | 9/2001 | |
| JP | 2004-279005 A | | 10/2004 | |
| JP | 2005-282993 A | | 10/2005 | |
| JP | 2012-220169 A | | 11/2012 | |
| JP | 2016-125727 A | | 7/2016 | |
| WO | WO-2006112321 A1 | * | 10/2006 | ..... F25B 13/00 |

OTHER PUBLICATIONS

JPH0328672A English Translation (Year: 1991).*
WO2006112321A1 English Translation (Year: 2006).*
International Search Report for PCT/JP2019/037656 dated Nov. 19, 2019.
International Preliminary Report on Patentability and English translation of the Written Opinion of the International Searching Authority, dated Apr. 8, 2021, for International Application No. PCT/JP2019/037656.
Extended European Search Report dated Aug. 18. 2021 in corresponding European Application No. 19866378.3.

* cited by examiner

*Primary Examiner* — Schyler S Sanks
(74) *Attorney, Agent, or Firm* — Birch, Stewart, Kolasch & Birch, LLP

(57) ABSTRACT

In an air-conditioning system including a thermal storage heat exchanger, a refrigerant circuit is configured such that an indoor heat exchanger and a receiver communicate with the thermal storage heat exchanger when an operational mode of the refrigerant circuit is switched to a cooling operation in which the thermal storage heat exchanger serves as a radiator and the indoor heat exchanger serves as an evaporator.

20 Claims, 14 Drawing Sheets

COOLING PEAK SHIFT OPERATION

COOLING PEAK CUT OPERATION

COOLING/COLD THERMAL STORAGE OPERATION

COLD THERMAL STORAGE OPERATION

HEATING PEAK CUT OPERATION

HEATING/WARM THERMAL STORAGE OPERATION

WARM THERMAL STORAGE OPERATION

AIR-CONDITIONING SYSTEM

CROSS REFERENCE TO RELATED APPLICATIONS

This application is a Continuation of PCT International Application No. PCT/JP2019/037656, filed on Sep. 25, 2019, which claims priority under 35 U.S.C. 119(a) to Patent Application No. 2018-184275, filed in Japan on Sep. 28, 2018, all of which are hereby expressly incorporated by reference into the present application.

TECHNICAL FIELD

The present disclosure relates to an air-conditioning system.

BACKGROUND ART

Some air-conditioning systems include a thermal storage heat exchanger (see, e.g., Patent Document 1). A thermal storage heat exchanger is generally configured to exchange heat between a thermal storage medium stored in a thermal storage tank and a refrigerant in a refrigerant circuit to store cold thermal energy and warm thermal energy. In an air-conditioning system including a thermal storage heat exchanger, it is possible to perform an operation reducing power consumption. In such an operation, for example, ice and cold water that were generated at the nighttime are stored in the thermal storage heat exchanger and utilized in the daytime so that the thermal storage heat exchanger serves as a radiator and an indoor heat exchanger serves as an evaporator.

CITATION LIST

Patent Document

Patent Document 1: Japanese Unexamined Patent Publication No. 2005-282993

SUMMARY

A first aspect of the present disclosure is directed to an air-conditioning system including a refrigerant circuit (50) to which a thermal storage heat exchanger (21) is connected.

The air-conditioning system includes: a refrigerant container (13, 14) capable of introducing a liquid refrigerant, wherein the refrigerant circuit (50) is configured such that the refrigerant container (13, 14) and an indoor heat exchanger (41) of the refrigerant circuit (50) are connected in parallel with respect to the thermal storage heat exchanger (21) when an operational mode is switched to a first cooling operation in which the thermal storage heat exchanger (21) serves as a radiator and the indoor heat exchanger (41) serves as an evaporator.

DESCRIPTION OF EMBODIMENTS

First Embodiment

Figure 1:
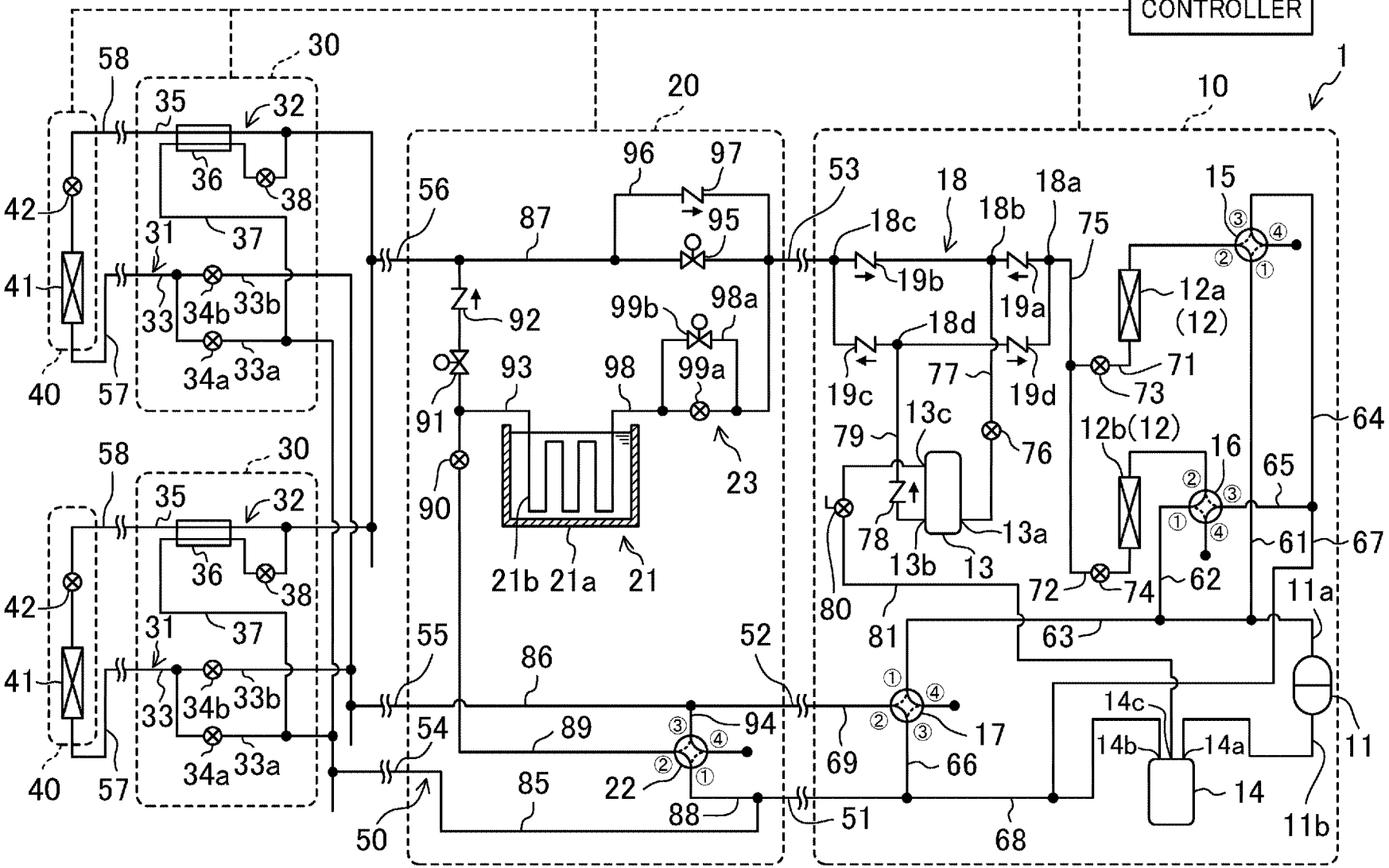
FIG. 1 is a piping system diagram illustrating a refrigerant circuit of an air-conditioning system of a first embodiment.

A first embodiment will be described.

An air-conditioning system (1) of the first embodiment includes an outdoor unit (heat-source-side unit) (10), a thermal storage unit (20), a plurality of flow path switching units (flow path switching unit (30)), and a plurality of indoor units (40) (utilization-side units), and a refrigerant circuit (50) to which these elements are connected via refrigerant pipes. The plurality of indoor units (40) and the plurality of flow path switching units (30) are connected in parallel to the outdoor unit (10) and the thermal storage unit (20). Each flow path switching unit (30) is connected between the thermal storage unit (20) and each indoor unit (40). The air-conditioning system (1) is configured to be able to perform a cooling operation and a heating operation at the same time, and includes a controller (control unit) (5) that controls the operation.

The outdoor unit (10) and the thermal storage unit (20) are connected to each other with an outdoor-side first gas communication pipe (51), an outdoor-side second gas communication pipe (52), and an outdoor-side liquid communication pipe (53). The thermal storage unit (20) and the flow path switching unit (30) are connected to each other via an intermediate portion first gas communication pipe (54), an intermediate portion second gas communication pipe (55), and an intermediate portion liquid communication pipe (56). The flow path switching unit (30) and the indoor unit (40) are connected to each other via an indoor-side gas communication pipe (57) and an indoor-side liquid communication pipe (58).

In this embodiment, three or more of the flow path switching units (30) and of the indoor units (40) are connected, but only two of each are illustrated. Portions of the intermediate portion first gas communication pipe (54), the intermediate portion second gas communication pipe (55), and the intermediate portion liquid communication pipe (56) which are connected to the third and subsequent flow path switching units (30) are not illustrated (omitted at a lower end in the drawing).

<Outdoor Unit>

The outdoor unit (10) is provided with a compressor (11), an outdoor heat exchanger (12), a receiver (refrigerant container) (13), an accumulator (14), a first four-way switching valve (15), a second four-way switching valve (16), a third four-way switching valve (17), a bridge circuit (18), and various valves constituting an outdoor-side valve mechanism for setting a flow direction of a refrigerant. A discharge pipe (11*a*) of the compressor (11) branches into a discharge-side first branch pipe (61), a discharge-side second branch pipe (62), and a discharge-side third branch pipe (63). The discharge-side first branch pipe (61) is connected to a first port of the first four-way switching valve (15), and the discharge-side second branch pipe (62) is connected to a first port of the second four-way switching valve (16). The discharge-side third branch pipe (63) is connected to a first port of the third four-way switching valve (17).

The outdoor heat exchanger (12) includes a first outdoor heat exchanger (12*a*) and a second outdoor heat exchanger (12*b*). A gas-side end of the first outdoor heat exchanger (12*a*) is connected to a second port of the first four-way switching valve (15), and a gas-side end of the second outdoor heat exchanger (12*b*) is connected to a second port of the second four-way switching valve (16). A suction-side first branch pipe (64) is connected to a third port of the first four-way switching valve (15), a suction-side second branch pipe (65) is connected to a third port of the second four-way switching valve (16), and a suction-side third branch pipe (66) is connected to a third port of the third four-way switching valve (17). The suction-side first branch pipe (64) and the suction-side second branch pipe (65) are connected to one end of an outdoor low-pressure pipe (67). A suction pipe (11*b*) of the compressor (11) is connected to a gas outflow port (14*a*) of the accumulator (14). One end of an outdoor-side first gas pipe (68) is connected to a first gas inflow port (14*b*) of the accumulator (14). Another end of the outdoor low-pressure pipe (67) joins together with the outdoor-side first gas pipe (68). Another end of the outdoor-side first gas pipe (68) is connected to the outdoor-side first gas communication pipe (51).

One end of an outdoor-side second gas pipe (69) is connected to a second port of the third four-way switching valve (17). Another end of the outdoor-side second gas pipe (69) is connected to the outdoor-side second gas communication pipe (52).

A fourth port of the first four-way switching valve (15), a fourth port of the second four-way switching valve (16), and a fourth port of the third four-way switching valve (17) are closed closure ports. Each of the first four-way switching valve (15), the second four-way switching valve (16), and the third four-way switching valve (17) is configured to be switchable to a first mode (communication mode indicated by solid lines FIG. 1) in which the first port and the second port communicate with each other and the third port and the fourth port communicate with each other, and a second mode (communication mode indicated by dashed lines in FIG. 1) in which the first port and the fourth port communicate with each other and the second port and the third port communicate with each other. In FIG. 1, the first four-way switching valve (15) and the second four-way switching valve (16) are in the first mode, and the third four-way switching valve (17) is in the second mode.

A liquid-side end of the first outdoor heat exchanger (12*a*) is connected to an outdoor-side liquid first branch pipe (71), and a liquid-side end of the second outdoor heat exchanger (12*b*) is connected to an outdoor-side liquid second branch pipe (72). An outdoor-side first expansion valve (expansion mechanism) (73) is connected to the outdoor-side liquid first branch pipe (71), and an outdoor-side second expansion valve (expansion mechanism) (74) is connected to the outdoor-side liquid second branch pipe (72). The outdoor-side liquid first branch pipe (71) and the outdoor-side liquid second branch pipe (72) join together and are connected to an outdoor-side liquid pipe (75). The outdoor-side liquid pipe (75) is connected to the outdoor-side liquid communication pipe (53) via the bridge circuit (18).

The receiver (13) capable of storing a liquid refrigerant is connected to the outdoor-side liquid pipe (75) via the bridge circuit (18). The bridge circuit (18) is a closed circuit having a first connecting point (18*a*), a second connecting point (18*b*), a third connecting point (18*c*), and a fourth connecting point (18*d*), which are connected to each other via pipes. A first check valve (19*a*) is provided between the first connecting point (18*a*) and the second connecting point (18*b*). The first check valve (19*a*) allows the refrigerant to flow in a direction from the first connecting point (18*a*) toward the second connecting point (18*b*) and disallows the refrigerant to flow in the reverse direction. A second check valve (19*b*) is provided between the third connecting point (18*c*) and the second connecting point (18*b*). The second check valve (19*b*) allows the refrigerant to flow in a direction from the third connecting point (18*c*) toward the second connecting point (18*b*) and disallows the refrigerant to flow in the reverse direction. A third check valve (19*c*) is provided between the fourth connecting point (18*d*) and the third connecting point (18*c*). The third check valve (19*c*) allows the refrigerant to flow in a direction from the fourth connecting point (18*d*) toward the third connecting point (18*c*) and disallows the refrigerant to flow in the reverse direction. A fourth check valve (19*d*) is provided between the fourth connecting point (18*d*) and the first connecting point (18*a*). The fourth check valve (19*d*) allows the refrigerant to flow in a direction from the fourth connecting point (18*d*) toward the first connecting point (18*a*) and disallows the refrigerant to flow in the reverse direction.

The second connecting point (18*b*) of the bridge circuit (18) and the liquid inflow port (13*a*) of the receiver (13) are connected by a refrigerant introduction pipe (77) having an outdoor flow rate regulating valve (first opening/closing mechanism) (76). A liquid outflow port (13*b*) of the receiver (13) and the fourth connecting point (18*d*) of the bridge circuit (18) are connected by a liquid outflow pipe (79). The liquid outflow pipe (79) is provided with an outdoor check valve (78) that allows the refrigerant to flow from the receiver (13) toward the fourth connecting point (18*d*) and disallows the refrigerant to flow in the reverse direction. The gas outflow port (13*c*) of the receiver (13) is connected to one end of a venting pipe (81) provided with a venting valve (second opening/closing mechanism) (80) whose opening degree is adjustable. Another end of the venting pipe (81) is connected to a second gas inflow port (14*c*) of the accumulator (14).

<Thermal Storage Unit>

The thermal storage unit (20) includes a thermal storage heat exchanger (21), a fourth four-way switching valve (22), a flow rate regulating mechanism (23), and various valves constituting a thermal storage-side valve mechanism for setting a flow direction of the refrigerant. The thermal storage heat exchanger (21) includes a thermal storage tank (21*a*) storing, for example, water as a thermal storage medium, and a multi-path (not shown) heat transfer tube (21*b*) provided inside the thermal storage tank (21*a*). The thermal storage heat exchanger (21) is of a so-called static type. During the cooling operation, when the thermal storage heat exchanger (21) serves as an evaporator, it generates ice around the heat transfer tube (21*b*) inside the thermal storage tank (21*a*) using a low-temperature refrigerant, whereas, when the thermal storage heat exchanger (21) serves as a radiator, the refrigerant dissipates heat to the ice. During heating operation, when the thermal storage heat exchanger (21) serves as a radiator, it heats water to generate warm water, whereas, when the thermal storage heat exchanger (21) serves as an evaporator, the refrigerant absorbs heat from the warm water.

The thermal storage unit (20) includes a thermal storage-side first gas pipe (85), a thermal storage-side second gas pipe (86), and a thermal storage-side liquid pipe (87). The thermal storage-side first gas pipe (85) is connected to the outdoor-side first gas communication pipe (51) and the intermediate portion first gas communication pipe (54). The thermal storage-side second gas pipe (86) is connected to the outdoor-side second gas communication pipe (52) and the intermediate portion second gas communication pipe (55). The thermal storage-side liquid pipe (87) is connected to the outdoor-side liquid communication pipe (53) and the intermediate portion liquid communication pipe (56).

A first port of the fourth four-way switching valve (22) is connected to the thermal storage-side first gas pipe (85) via a first connection pipe (communication passage) (88). One end of a second connection pipe (communication passage) (89) is connected to a second port of the fourth four-way switching valve (22). Another end of the second connection pipe (89) is connected to the thermal storage-side liquid pipe (87). A thermal storage-side first flow rate regulating valve (90) configured as a motor-operated valve, a thermal storage-side first open/close valve (91) (electromagnetic valve), and a thermal storage-side first check valve (92) allowing the refrigerant to flow only in a direction toward the thermal storage-side liquid pipe (87) are arranged in series in the second connection pipe (89). The thermal storage-side first flow rate regulating valve (90) is a variable throttle mechanism that may be set to a fully open position, a fully closed position, or an intermediate position between the fully open position and the fully closed position. A thermal storage-side first branch pipe (93), connected to the second connection pipe (89) at a position between the thermal storage-side first flow rate regulating valve (90) and the thermal storage-side first open/close valve (91), is connected to a gas-side end of the heat transfer tube (21*b*) of the thermal storage heat exchanger (21). A third port of the fourth four-way switching valve (22) is connected to the thermal storage-side second gas pipe (86) via a third connection pipe (94). A fourth port of the fourth four-way switching valve (22) is a closed closure port.

The fourth four-way switching valve (22) is configured to be switchable to a first mode (mode indicated by solid lines FIG. 1) in which the first port and the second port communicate with each other and the third port and the fourth port communicate with each other, and a second mode (mode indicated by dashed lines in FIG. 1) in which the first port and the fourth port communicate with each other and the second port and the third port communicate with each other.

The thermal storage-side liquid pipe (87) is provided with a thermal storage-side second open/close valve (95). The thermal storage-side second open/close valve (95) is configured to allow the refrigerant to flow only in a direction from the outdoor-side liquid pipe (75) toward the intermediate portion liquid communication pipe (56). A first bypass passage (96) bypassing the thermal storage-side second open/close valve (95) is connected to the thermal storage-side liquid pipe (87). The first bypass passage (96) is provided with a thermal storage-side second check valve (97) that allows the refrigerant to flow from the intermediate portion liquid communication pipe (56) toward the outdoor-side liquid pipe (75), and disallows the refrigerant to flow in the reverse direction.

A liquid-side end of the thermal storage heat exchanger (21) is connected to the thermal storage-side liquid pipe (87) at a position between the outdoor-side liquid pipe (75) and the thermal storage-side second open/close valve (95), via a thermal storage-side second branch pipe (98). The flow rate regulating mechanism (23) is connected to the thermal storage-side second branch pipe (98). The flow rate regulating mechanism (23) includes a thermal storage-side flow rate regulating valve (opening degree adjusting valve) (99*a*) provided in the thermal storage-side second branch pipe (98), and a thermal storage-side third open/close valve (electromagnetic valve) (99*b*) provided in a second bypass passage (98*a*) bypassing the thermal storage-side flow rate regulating valve (99*a*) (opening adjusting valve).

<Flow Path Switching Unit>

The flow path switching unit (30) includes a gas-side connection pipe (31), a liquid-side connection pipe (32), and various valves constituting a switching portion valve mechanism for setting the flow direction of the refrigerant. The gas-side connection pipe (31) includes a gas-side main pipe (33), a switching portion first branch pipe (33*a*), and a switching portion second branch pipe (33*b*). The switching portion first branch pipe (33*a*) is provided with a first flow path switching valve (34*a*). The switching portion second branch pipe (33*b*) is provided with a second flow path switching valve (34*b*). One end of the gas-side main pipe (33) is connected to the indoor-side gas communication pipe (57). Another end of the gas-side main pipe (33) is connected to one end of the switching portion first branch pipe (33*a*) and one end of the switching portion second branch pipe (33*b*). Another end of the switching portion first branch pipe (33*a*) is connected to the intermediate portion first gas communication pipe (54). Another end of the switching portion second branch pipe (33*b*) is connected to the intermediate portion second gas communication pipe (55).

The first flow path switching valve (34*a*) and the second flow path switching valve (34*b*) are control valves allowing or disallowing the refrigerant to flow in each flow path switching unit (30). Each flow path switching valve (34*a*, 34*b*) is configured as a motor-operated regulating valve capable of regulating an opening degree by driving a motor. Thus, flow paths of the indoor refrigerant in the refrigerant circuit (50) may be switched by electric control. The flow of the refrigerant may be controlled by opening or closing the motor-operated regulating valve. The cooling operation and the heating operation may be switched in each indoor unit (40) separately. Note that an electromagnetic open/close valve may be used for each flow path switching valve (34*a*, 34*b*) instead of the motor-operated regulating valve.

The liquid-side connection pipe (32) includes a liquid-side main pipe (35) to which a subcooling heat exchanger (36) is connected. One end of a subcooling pipe (37) is connected to the liquid-side main pipe (35) at a position between the intermediate portion liquid communication pipe (56) and the subcooling heat exchanger (36). The subcooling pipe (37) passes through the inside of the subcooling heat exchanger (36), and another end of the subcooling pipe (37) is connected to the switching portion first branch pipe (33*a*) at a position between the first flow path switching valve (34*a*) and the intermediate portion first gas communication pipe (54). The subcooling pipe (37) is provided with a flow rate regulating valve (38) between the liquid-side main pipe (35) and the subcooling heat exchanger (36). The amount of the refrigerant flowing into the subcooling circuit is regulated by regulating an opening degree of the flow rate regulating valve (38).

<Indoor Unit>

Each indoor unit (40) includes an indoor heat exchanger (41) and an indoor expansion valve (42). The indoor expansion valve (42) is configured as an electronic expansion valve capable of regulating its opening degree. In the indoor unit (40), a gas-side end of the indoor heat exchanger (41) is connected to the flow path switching unit (30) via the indoor-side gas communication pipe (57), and the indoor expansion valve (42) is connected to the flow path switching unit (30) via the indoor-side liquid communication pipe (58).

<Controller>

The controller (5) that is a control unit includes a microcomputer mounted on a control board, and a memory device (specifically, a semiconductor memory) storing software for operating the microcomputer. The controller (5) controls various appliances of the air-conditioning system (1) on the basis of an operation command or a detection signal of a sensor. Controlling the various appliances by the controller (5) makes it possible to switch operations of the air-conditioning system (1).

The drawing illustrates a configuration in which one controller (5) is connected to each unit and a refrigerant switching device. However, depending on installation conditions, the controller (5) may include a plurality of controllers (5) and the respective controllers (5) may be configured to perform control together.

—Operation—

The air-conditioning system (1) of this embodiment switches a cooling operation, a cooling peak shift operation (subcooling operation), a cooling peak cut operation (first cooling operation), a cooling/cold thermal storage operation, a cold thermal storage operation, a heating operation, a heating peak cut operation, a heating/warm thermal storage operation, and a warm thermal storage operation to perform the operation. In the air-conditioning system (1), switching settings of a refrigerant flow direction in the flow path switching unit (30) allows the cooling operation and the heating operation in the plurality of indoor units (40) to be performed. However, an explanation of this process will be omitted.

Hereinafter, an operation in the refrigerant circuit (50) in each operation mode will be described.

<Cooling Operation>

Figure 2:
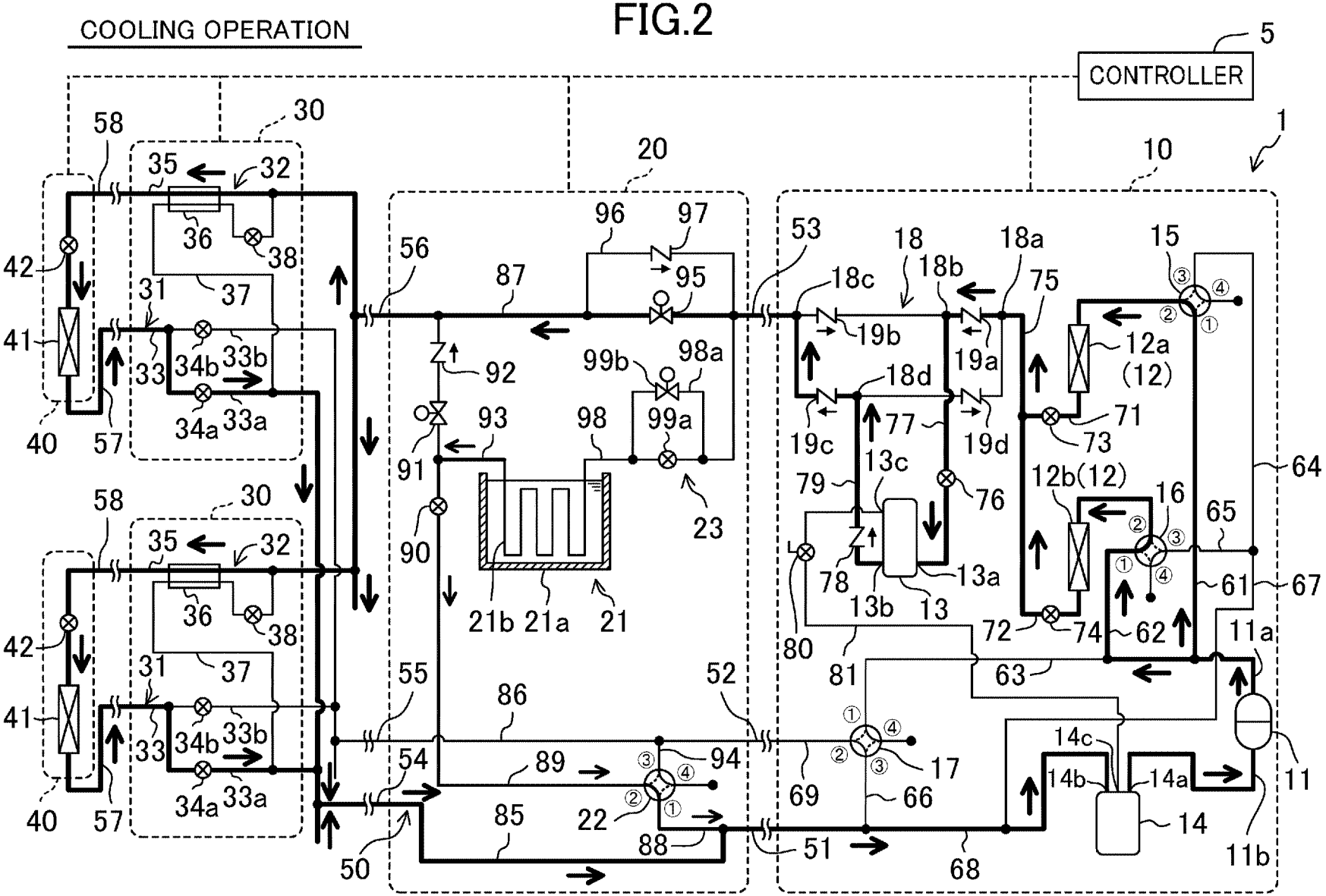
FIG. 2 is a diagram illustrating a flow of a refrigerant during a cooling operation.

The cooling operation shown in FIG. 2 is an operation in which the refrigerant circulates in the refrigerant circuit (50) with the outdoor heat exchanger (12) serving as a radiator and the indoor heat exchanger (41) serving as an evaporator without use of the thermal storage heat exchanger (21).

During the cooling operation, the first four-way switching valve (15) and the second four-way switching valve (16) in the outdoor unit (10) are set to the first mode. In a mode shown in FIG. 2, both the outdoor-side first expansion valve (73) and the outdoor-side second expansion valve (74) are in the fully open position. However, if the operation is performed by only one outdoor heat exchanger (12), either the outdoor-side first expansion valve (73) or the outdoor-side second expansion valve (74) is closed (this applies to each operation described below). The outdoor flow rate regulating valve (76) is set to be in the fully open position.

In the thermal storage unit (20), the thermal storage-side second open/close valve (95) is open, and the thermal storage-side flow rate regulating valve (99*a*) and the thermal storage-side third open/close valve (99*b*) are closed. The thermal storage-side first flow rate regulating valve (90) is controlled to a predetermined opening degree, and the thermal storage-side second open/close valve (95) is closed.

Assuming that the cooling operation is performed in each indoor unit (40), the first flow path switching valve (34*a*) is open, the second flow path switching valve (34*b*) is closed, and the flow rate regulating valve (38) is controlled to a predetermined opening degree, in the flow path switching unit (30). In the indoor unit (40), the indoor expansion valve (42) is controlled to a predetermined opening degree.

Note that, although not shown, if there are the indoor unit (40) performing the cooling operation and the indoor unit (40) performing the heating operation, the third four-way switching valve (17) of the outdoor unit (10) is switched to the second mode, the indoor expansion valve (42) of the indoor unit (40) performing the heating operation is fully open, the first flow path switching valve (34*a*) is closed, and the second flow path switching valve (34*b*) is open.

During the cooling operation shown in FIG. 2, the refrigerant that has been discharged from the compressor (11) dissipates heat in the first outdoor heat exchanger (12*a*) and the second outdoor heat exchanger (12*b*), and the condensed or cooled refrigerant flows into the receiver (13). The refrigerant flowing out of the receiver (13) passes through the thermal storage-side liquid pipe (87) of the thermal storage unit (20). Then, the refrigerant is subcooled in the flow path switching unit (30), and flows into the indoor unit (40).

In the indoor unit (40), the refrigerant is decompressed by the indoor expansion valve (42), absorbs heat from indoor air in the indoor heat exchanger (41), and evaporates. At this time, the indoor air is cooled and the indoor space is cooled. The refrigerant that flowed out of the indoor unit (40) passes through the gas-side connection pipe (31) of the flow path switching unit (30) and the thermal storage-side first gas pipe (85) of the thermal storage unit (20), and returns to the outdoor unit (10). The refrigerant flows from the outdoor-side first gas pipe (68) of the outdoor unit (10) into the accumulator (14), and then is sucked into the compressor (11).

Figure 11:
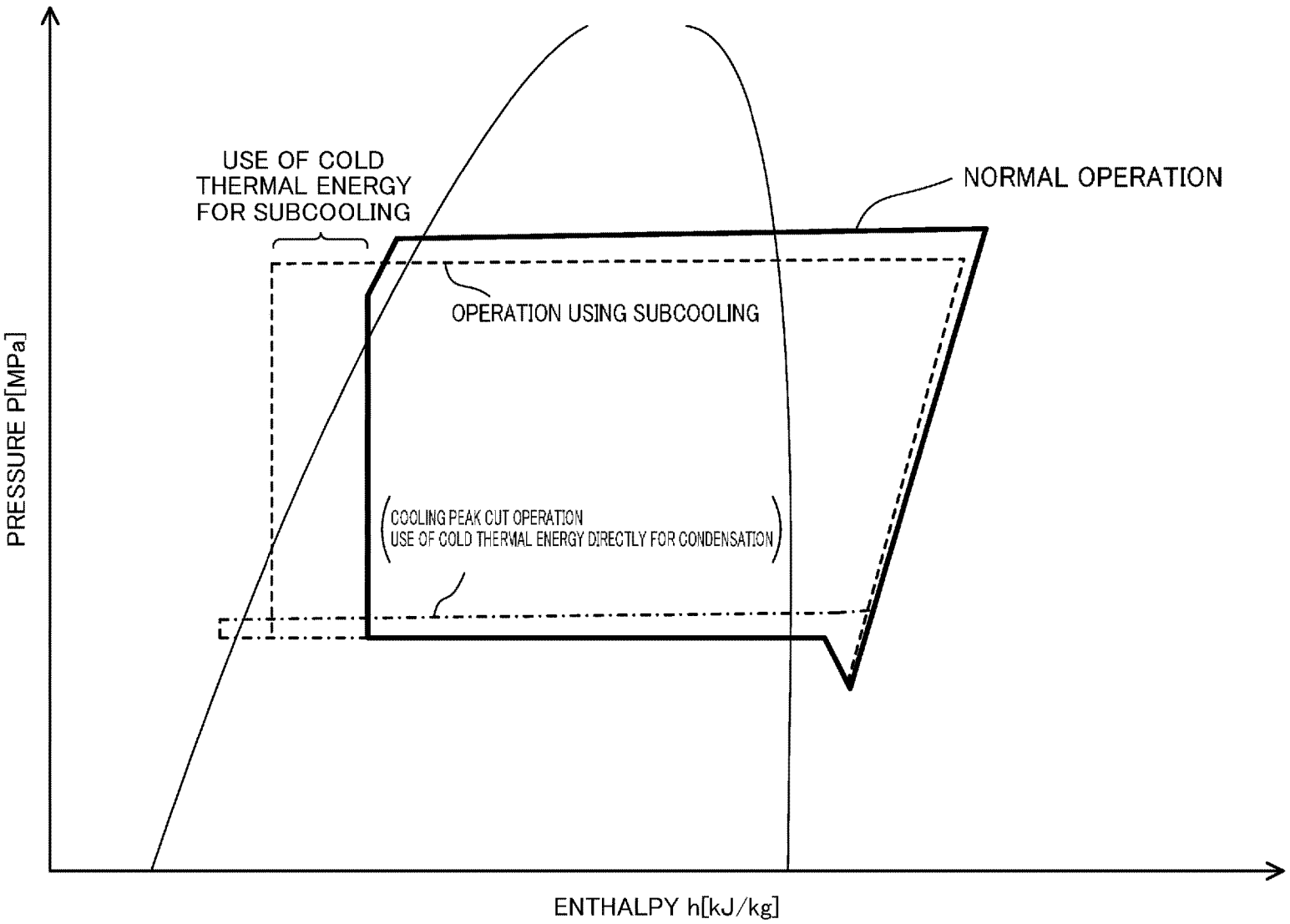
FIG. 11 is a P-h diagram illustrating the cooling operation, the cooling peak shift operation, and the cooling peak cut operation.

During the cooling operation, a refrigeration cycle in which the above operation is continued is performed in the refrigerant circuit (50). FIG. 11 shows a P-h diagram of the refrigeration cycle indicated as "normal operation." In this mode, a difference between high and low pressure of the refrigerant is larger and an enthalpy difference is smaller than in the cooling peak cut operation and the cooling peak shift operation described below.

Assume that the liquid refrigerant is accumulated in the heat transfer tube (21*b*) of the thermal storage heat exchanger (21) during normal cooling operation in which the outdoor heat exchanger (12) serves as a radiator. In such a case, during the later-described cooling peak cut operation in which power consumption is reduced by allowing the thermal storage heat exchanger (21), instead of the outdoor heat exchanger (12), to serve as the radiator, it may be impossible for the thermal storage heat exchanger (21) to achieve its original heat exchange capacity as a radiator until the liquid refrigerant is pushed out from the thermal storage heat exchanger (21). In this case, quick response to the cooling peak cut operation is impossible.

In the present embodiment, providing a thermal storage-side first flow rate regulating valve (90) to the second connection pipe (89) allows the liquid refrigerant to be released to the pipe (85) where pressure is low during the cooling operation, even if the liquid refrigerant is accumulated in the thermal storage heat exchanger (21). Therefore, when the thermal storage heat exchanger (21), instead of the outdoor heat exchanger (12), is allowed to serve as the radiator to perform the cooling peak cut operation, the time required for the liquid refrigerant to be pushed out is shortened, and the thermal storage heat exchanger (21) achieves the heat exchange capacity (functions as a radiator) immediately. Thus, quick response to the cooling peak cut operation is possible.

<Cooling Peak Shift Operation>

Figure 3:
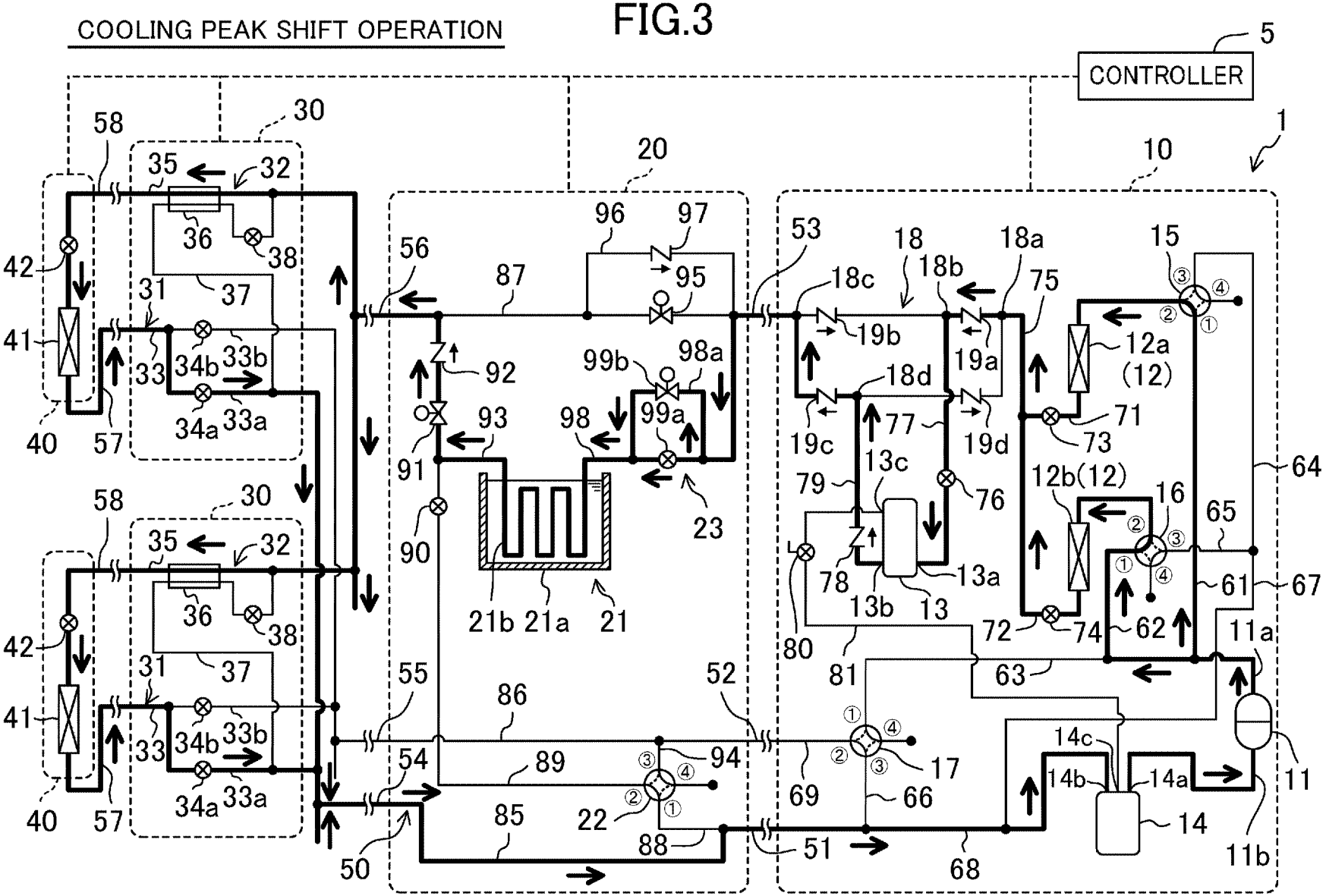
FIG. 3 is a diagram illustrating a flow of the refrigerant during a cooling peak shift operation.

The cooling peak shift operation shown in FIG. 3 is an operation in which the refrigerant circulates in the refrigerant circuit (50) with the thermal storage heat exchanger (21), in which ice is generated inside the thermal storage tank (21*a*), being used as the subcooling heat exchanger (36), the outdoor heat exchanger (12) serving as a radiator, and the indoor heat exchanger (41) serving as an evaporator.

During the cooling peak shift operation, the outdoor unit (10), the flow path switching unit (30), and the various valves of the indoor unit (40) are controlled in the same manner as in the cooling operation. In the thermal storage unit (20), the thermal storage-side second open/close valve (95) is closed, and the thermal storage-side flow rate regulating valve (99*a*) and the thermal storage-side third open/close valve (99*b*) are open. Note that the thermal storage-side third open/close valve (99*b*) may be open and the thermal storage-side flow rate regulating valve (99*a*) may be closed. The thermal storage-side first flow rate regulating valve (90) is closed and the thermal storage-side first open/close valve (91) is open.

During the cooling peak shift operation, the refrigerant that has been discharged from the compressor (11) dissipates heat in the first outdoor heat exchanger (12*a*) and the second outdoor heat exchanger (12*b*), and the condensed or cooled refrigerant flows into the receiver (13). The refrigerant that has flowed out of the receiver (13) branches from the thermal storage-side liquid pipe (87) of the thermal storage unit (20) into the thermal storage-side second branch pipe (98), and flows into the thermal storage heat exchanger (21) to be subcooled.

The subcooled refrigerant passes through each flow path switching unit (30) and flows into each indoor unit (40). The refrigerant is decompressed by the indoor expansion valve (42), and then evaporates in the indoor heat exchanger (41). At that time, the indoor air is cooled and the indoor space is cooled. The refrigerant that has been evaporated in the indoor heat exchanger (41) passes through the gas-side connection pipe (31) of the flow path switching unit (30) and the thermal storage-side first gas pipe (85) of the thermal storage unit (20), and returns to the outdoor unit (10). The refrigerant that has returned to the outdoor unit (10) is sucked into the compressor (11) via the accumulator (14).

As shown in FIG. 11 illustrating the P-h diagram of the cooling peak shift operation, in this mode, the difference between high and low pressure of the refrigerant is smaller than in the cooling operation, and the enthalpy difference is larger than in the cooling operation since the refrigerant is subcooled in the thermal storage heat exchanger (21). Since the difference between high and low pressure is small, a small input of the compressor (11) is sufficient. Thus, the power consumption is reduced and a coefficient of performance (COP) is high, as compared to the normal cooling operation.

<Cooling Peak Cut Operation>

Figure 4:
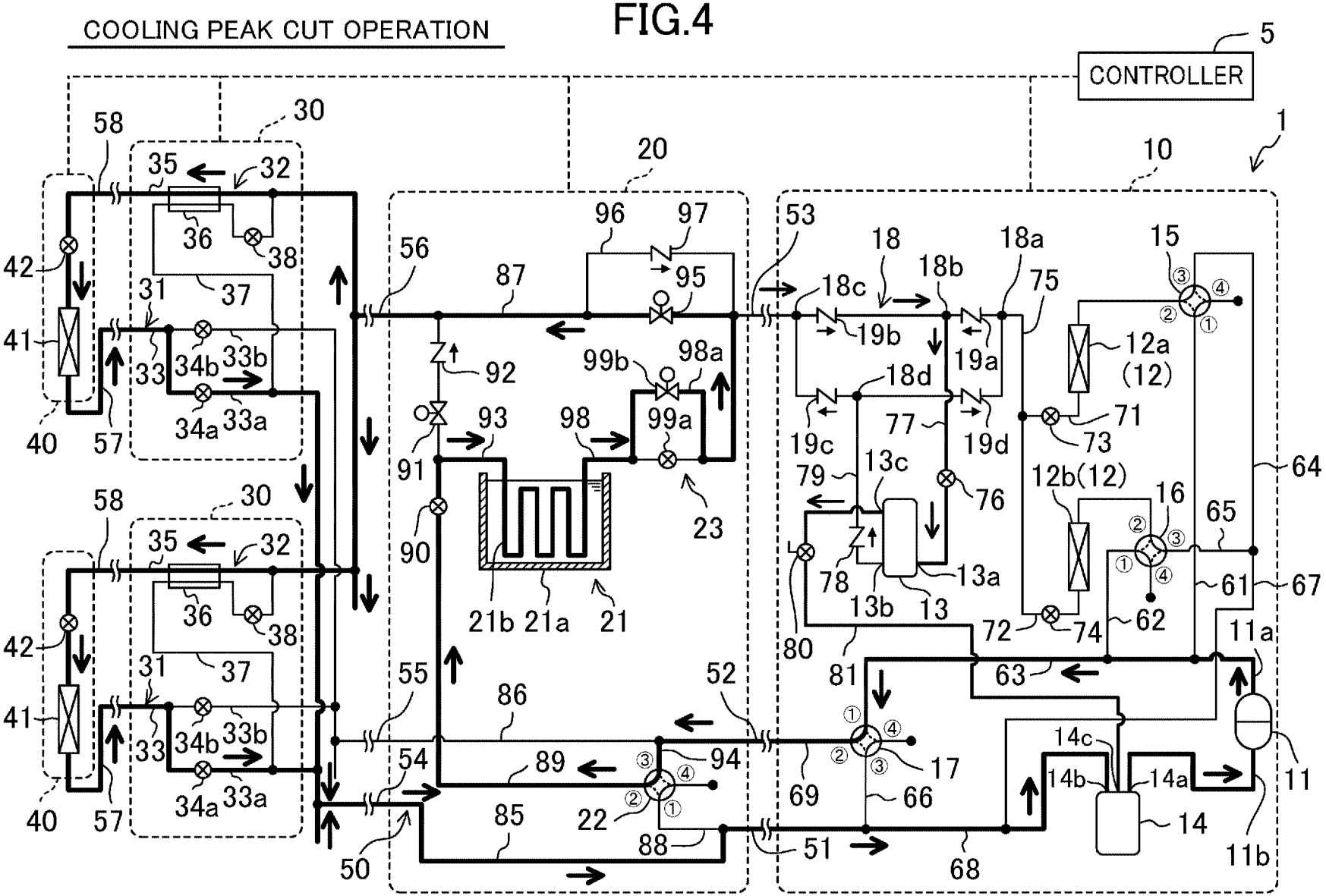
FIG. 4 is a diagram illustrating a flow of the refrigerant during a cooling peak cut operation.

The cooling peak cut operation (first cooling operation) shown in FIG. 4 is a cooling operation (first cooling operation) in which the refrigerant circulates in the refrigerant circuit (50) with the thermal storage heat exchanger (21), which has the thermal storage tank (21*a*) in which water is generated, serving as a radiator, and the indoor heat exchanger (41) serving as an evaporator. In this operation, the outdoor heat exchanger (12) is not used. In the present embodiment, the cooling peak cut operation is an operation decreasing the difference between high and low pressure in the refrigerant circuit (50) to reduce input of the compressor (11), and thus reducing power consumption for cooling, as compared to the cooling operation in which the outdoor heat exchanger (12) serves as a radiator, and the cooling operation (cooling peak shift operation) in which the thermal storage heat exchanger (21) serves as a subcooling heat exchanger.

During the cooling peak cut operation, the first four-way switching valve (15) and the second four-way switching valve (16) in the outdoor unit (10) are set to the second mode, and the third four-way switching valve (17) is set to the first mode. The outdoor-side first expansion valve (73) and the outdoor-side second expansion valve (74) are controlled to be closed, and the outdoor flow rate regulating valve (76) and the venting valve (80) have their opening degrees appropriately controlled.

In the thermal storage unit (20), the fourth four-way switching valve (22) is set to the second mode, the thermal storage-side first flow rate regulating valve (90) is open, and the thermal storage-side first open/close valve (91) is closed. The thermal storage-side second open/close valve (95) and the thermal storage-side third open/close valve (99*b*) are open, and the thermal storage-side flow rate regulating valve (99*a*) is closed. The valves in the flow path switching unit (30) and the indoor unit (40) are controlled in the same manner as in the cooling operation and the cooling peak shift operation.

During the cooling peak cut operation, the thermal storage heat exchanger (21) serves as a radiator, and the indoor heat exchanger (41) of the refrigerant circuit (50) serves as an evaporator, as described above. When the operational mode is switched to the cooling peak cut operation from another mode, the refrigerant container (13, 14) and the indoor heat exchanger (41) are connected in parallel with respect to the thermal storage heat exchanger (21) in the refrigerant circuit (50) during the cooling peak cut operation.

During the cooling peak cut operation, the refrigerant that has been discharged from the compressor (11) does not flow into the first outdoor heat exchanger (12*a*) and the second indoor heat exchanger (41), but flows through the third four-way switching valve (17) and the fourth four-way switching valve (22), and flows into the thermal storage heat exchanger (21) to dissipate heat. The refrigerant that has been condensed or cooled in the thermal storage heat exchanger (21) passes through the thermal storage-side third open/close valve (99*b*) and the thermal storage-side second open/close valve (95) to flow out of the thermal storage unit (20), and flows into each indoor unit (40) through each flow path switching unit (30).

The refrigerant is decompressed by the indoor expansion valve (42), and then evaporates in the indoor heat exchanger (41). At that time, the indoor air is cooled and the indoor space is cooled. The refrigerant that has been evaporated in the indoor heat exchanger (41) returns to the outdoor unit (10) through the gas-side connection pipe (31) of the flow path switching unit (30) and the thermal storage-side first gas pipe (85) of the thermal storage unit (20). The refrigerant that has returned to the outdoor unit (10) is sucked into the compressor (11) via the accumulator (14).

As shown in FIG. 11 illustrating the P-h diagram of the cooling peak cut operation, in this mode, the difference between high and low pressure of the refrigerant is significantly smaller than in the cooling operation, and the enthalpy difference is larger than in the cooling operation. In this way, in the cooling peak cut operation, the refrigeration cycle in which the high pressure is extremely low is performed, the difference between high and low pressure is small, and thus a small input of the compressor (11) is sufficient. Therefore, the power consumption is reduced and the coefficient of performance (COP) is high, as compared to the normal cooling operation and the cooling peak shift operation.

In the present embodiment, the opening degrees of the outdoor flow rate regulating valve (76) and the venting valve (80) are appropriately controlled. This allows a part of the refrigerant that has flowed out of the thermal storage heat exchanger (21) to flow into the receiver (13) used as the refrigerant container, and to substantially prevent the refrigerant from flowing in a large amount into the indoor heat exchanger (41).

On the contrary, in a case where the refrigerant container is not used during the cooling peak cut operation, a pressure of the liquid refrigerant in the liquid pipe flowing from the thermal storage heat exchanger (21) to the indoor heat exchanger (41) increases, which may make it impossible to quickly shift to the cooling peak cut operation despite the cooling peak cut operation process being performed. In the present embodiment, the increase in the high pressure is reduced by reducing the flow rate of the refrigerant flowing from the thermal storage heat exchanger (21) to the indoor heat exchanger (41). Thus, the difference between the high and low pressure during the peak cut operation is small, and the quick response to the operation, in which the power consumption of the compressor (11) is small and the COP is high, is possible.

In the present embodiment, the pressure of the refrigerant in the thermal storage heat exchanger (21) may be adjusted to reach a target value by adjusting the opening degrees of the outdoor-side flow rate control valve (76) and the venting valve (80) during the cooling peak cut operation. The configuration in which the high pressure of the refrigerant can be adjusted enables the increase in the high pressure to be reduced and the power consumption to be reduced by decreasing the input of the compressor. Further, regulating the high pressure of the refrigerant enables the input of the compressor to be freely regulated, thus facilitating the operation control.

In the present embodiment, during the cooling peak cut operation, a degree of subcooling of the refrigerant in the thermal storage heat exchanger (21) may be adjusted by adjusting opening degrees of the outdoor-side flow rate control valve (76) and the venting valve (80). Adjusting the degree of subcooling of the refrigerant in the thermal storage heat exchanger (21) enables the cooling capacity to be adjusted by adjusting the enthalpy difference shown in the P-h diagram. Therefore, an operation in which the COP is high can be performed.

<Cooling/Cold Thermal Storage Operation>

Figure 5:
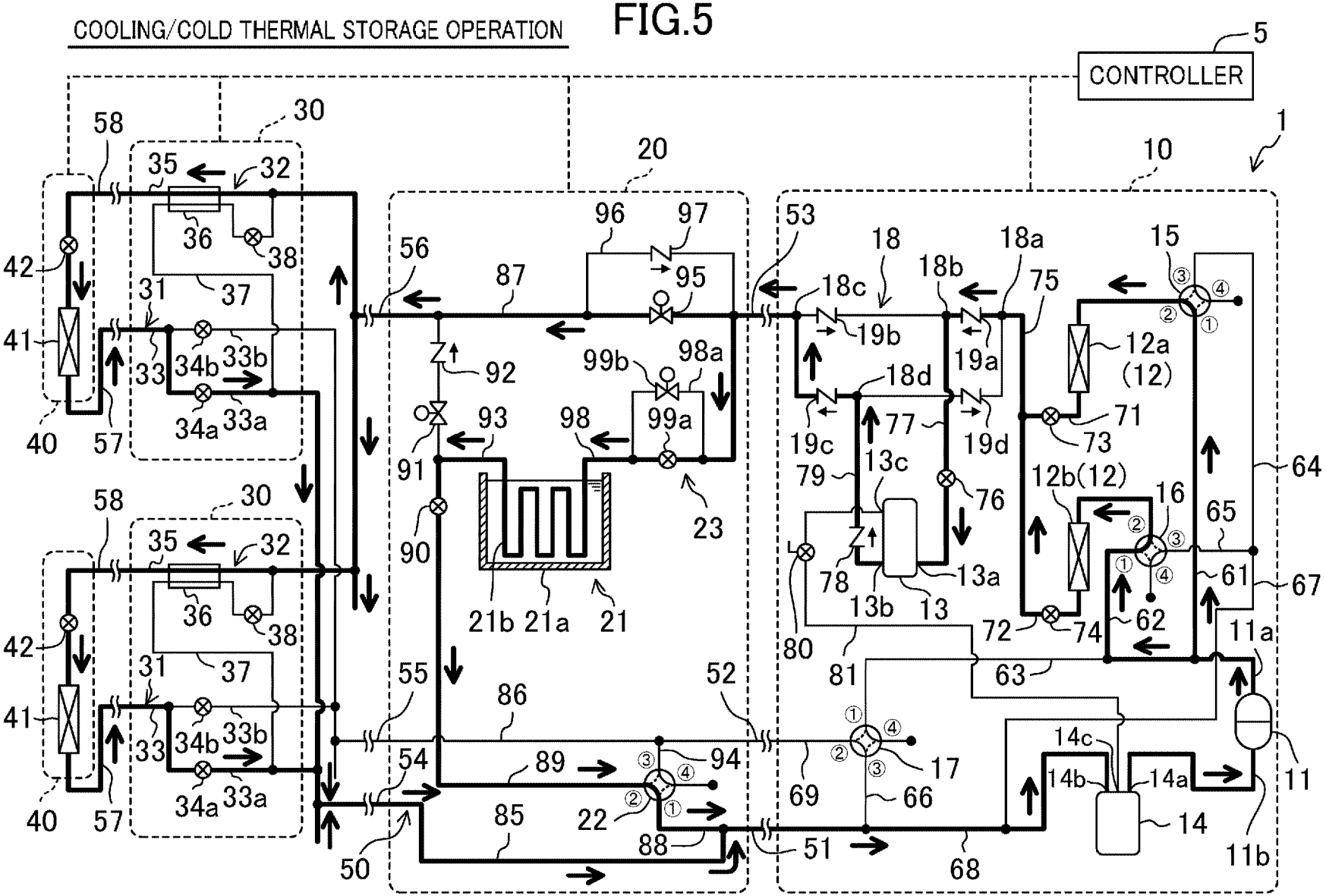
FIG. 5 is a diagram illustrating a flow of the refrigerant during a cooling/cold thermal storage operation.

The cooling/cold thermal storage operation shown in FIG. 5 is an operation in which water in the thermal storage tank (21*a*) is cooled using the thermal storage heat exchanger (21) as an evaporator to store cold thermal energy, while the cooling operation shown in FIG. 2 is performed.

In the cooling/cold thermal storage operation, all valves are in the same position as in the cooling operation shown in FIG. 2, except that, in the thermal storage unit (20), the opening degree of the thermal storage-side flow rate regulating valve (99*a*) is appropriately adjusted, the thermal storage-side third open/close valve (99*b*) is closed, the thermal storage-side first flow rate regulating valve (90) is open, and the thermal storage-side first open/close valve (91) is closed.

During the cooling/cold thermal storage operation, the refrigerant that has been discharged from the compressor (11) dissipates heat in the first outdoor heat exchanger (12*a*) and the second outdoor heat exchanger (12*b*), and the condensed or cooled refrigerant flows into the receiver (13). The refrigerant flowing out of the receiver (13) passes through the thermal storage-side liquid pipe (87) of the thermal storage unit (20). Then, the refrigerant is subcooled in the flow path switching unit (30), and flows into the indoor unit (40).

In the indoor unit (40), the refrigerant is decompressed by the indoor expansion valve (42), absorbs heat from indoor air in the indoor heat exchanger (41), and evaporates. At this time, the indoor air is cooled and the indoor space is cooled. The refrigerant that has flowed out of the indoor unit (40) flows through the gas-side connection pipe (31) of the flow path switching unit (30) and the thermal storage-side first gas pipe (85) of the thermal storage unit (20).

On the other hand, a part of the refrigerant flowing through the thermal storage-side liquid pipe (87) branches into the thermal storage-side second branch pipe (98), is decompressed by the thermal storage-side flow rate regulating valve (99*a*), flows into the thermal storage heat exchanger (21), and evaporates. The evaporated refrigerant passes through the second connection pipe (89) and the first connection pipe (88) and merges with the refrigerant in the thermal storage-side first gas pipe (85).

The refrigerant flowing in the thermal storage-side first gas pipe (85) returns to the outdoor unit (10) through the outdoor-side first gas communication pipe (51). The refrigerant flows from the outdoor-side first gas pipe (68) of the outdoor unit (10) into the accumulator (14), and then is sucked into the compressor (11).

<Cold Thermal Storage Operation>

Figure 6:
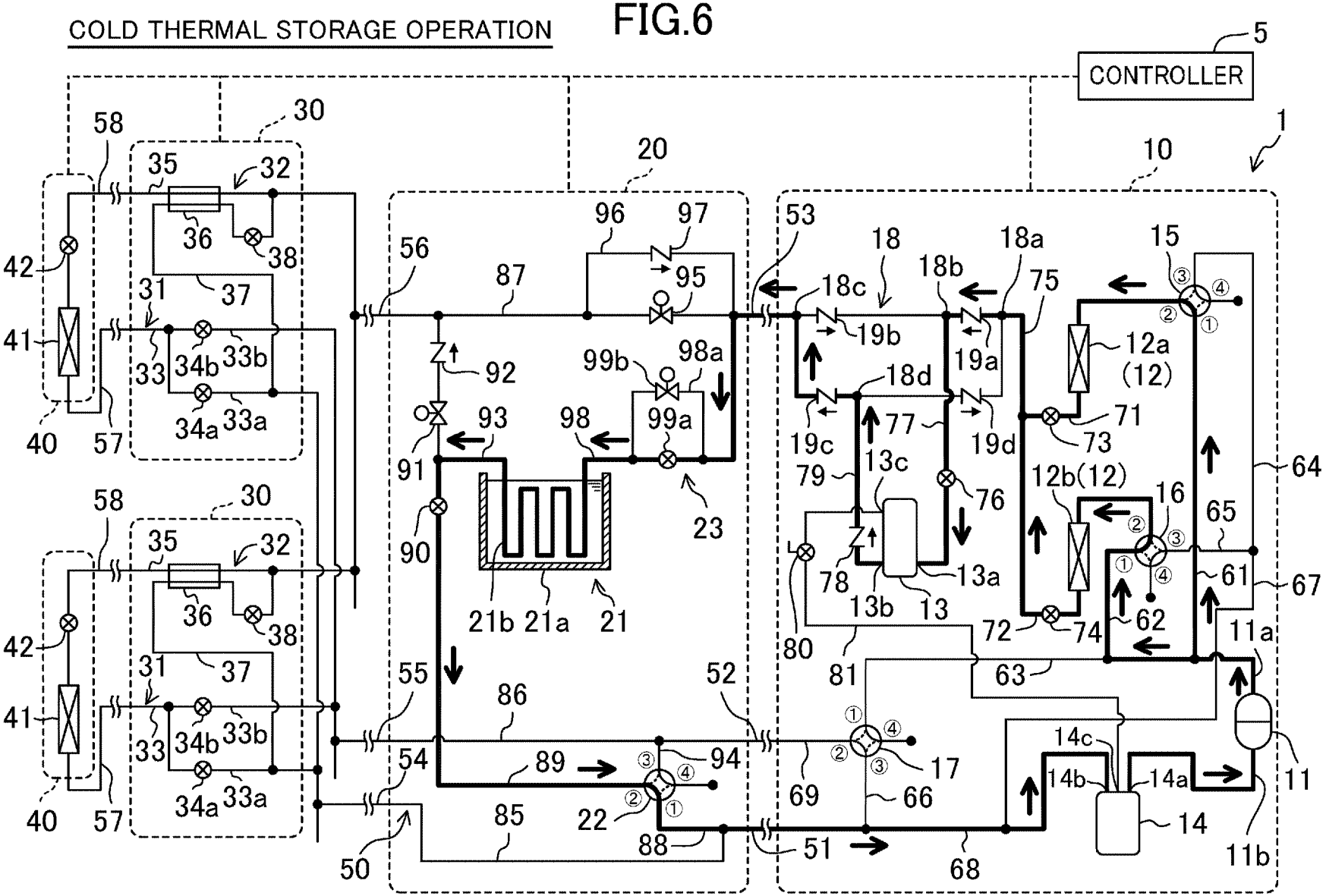
FIG. 6 is a diagram illustrating a flow of the refrigerant during a cold thermal storage operation.

The cold thermal storage operation shown in FIG. 6 is an operation in which water in the thermal storage tank (21*a*) is cooled by using the outdoor heat exchanger (12) as a radiator and the thermal storage heat exchanger (21) as an evaporator to store cold thermal energy.

In the cold thermal storage operation, the valves in the outdoor unit (10) are controlled in the same manner as in the cooling/cold thermal storage operation shown in FIG. 5. In the thermal storage unit (20), the valves may be controlled in the same manner as in the cooling/cold thermal storage operation, except that the thermal storage-side second open/close valve (95) is closed to substantially prevent the refrigerant from flowing to the flow path switching unit (30) and the indoor unit (40).

During the cold thermal storage operation, the refrigerant that has been discharged from the compressor (11) dissipates heat in the first outdoor heat exchanger (12*a*) and the second outdoor heat exchanger (12*b*), and the condensed or cooled refrigerant flows into the receiver (13). The refrigerant that has flowed out of the receiver (13) flows into the thermal storage-side second branch pipe (98), is decompressed by the thermal storage-side flow rate regulating valve (99*a*), and evaporates in the thermal storage heat exchanger (21).

The evaporated refrigerant passes through the second connection pipe (89) and the first connection pipe (88). The refrigerant flowing in the first connection pipe (88) returns to the outdoor unit (10) through the outdoor-side first gas communication pipe (51). The refrigerant flowing in the outdoor-side first gas communication pipe (51) returns to the outdoor unit (10). The refrigerant flows from the outdoor-side first gas pipe (68) of the outdoor unit (10) into the accumulator (14), and then is sucked into the compressor (11).

<Heating Operation>

Figure 7:
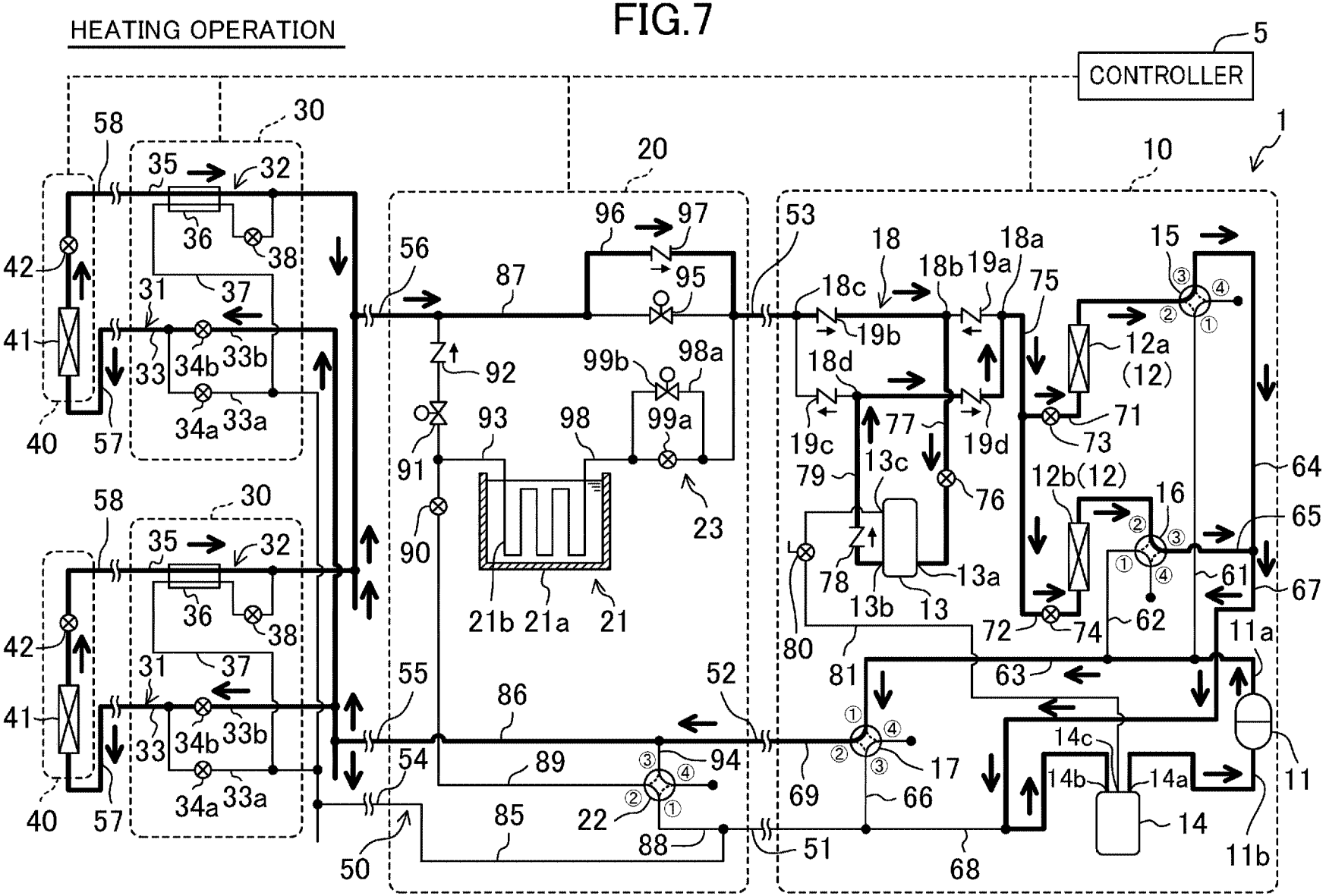
FIG. 7 is a diagram illustrating a flow of the refrigerant during a heating operation.

The heating operation shown in FIG. 7 is an operation in which the refrigerant circulates in the refrigerant circuit (50) with the indoor heat exchanger (41) serving as a radiator and the outdoor heat exchanger (12) serving as an evaporator without use of the thermal storage heat exchanger (21).

During the heating operation, the first four-way switching valve (15) and the second four-way switching valve (16) in the outdoor unit (10) are set to the second mode. Both the outdoor-side first expansion valve (73) and the outdoor-side second expansion valve (74) are controlled to a predetermined opening degree. However, if the operation is performed by only one outdoor heat exchanger (12), one of the outdoor-side first expansion valve (73) and the outdoor-side second expansion valve (74) is closed (this also applies to each operation described below). The outdoor flow rate regulating valve (76) is set to be fully open.

In the thermal storage unit (20), the thermal storage-side second open/close valve (95) is closed, and the thermal storage-side flow rate regulating valve (99*a*) and the thermal storage-side third open/close valve (99*b*) are closed.

In the flow path switching unit (30), if the heating operation is performed in each indoor unit (40), the first flow path switching valve (34*a*) is closed, the second flow path switching valve (34*b*) is open, and the flow rate regulating valve (38) is closed. In the indoor unit (40), the indoor expansion valve (42) is controlled to be fully open.

During the heating operation, the refrigerant that has been discharged from the compressor (11) passes through the third four-way switching valve (17) and through the thermal storage-side second gas pipe (86) of the thermal storage unit (20), then passes through the gas-side connection pipe (31) of the flow path switching unit (30), and flows into the indoor unit (40). The refrigerant dissipates heat in the indoor heat exchanger (41). Then, the condensed or cooled refrigerant flows out of the indoor unit (40), flows through the liquid-side connection pipe (32) of the flow path switching unit (30), and flows from the intermediate portion liquid communication pipe (56) into the thermal storage unit (20). The refrigerant flows out of the thermal storage-side liquid pipe (87) of the thermal storage unit (20), passes through the first bypass passage (96), and returns to the outdoor unit (10) from the outdoor-side liquid communication pipe (53).

The refrigerant flows into the receiver (13) through the refrigerant introduction pipe (77), and then flows out to the liquid outflow pipe (79). The refrigerant passes through the bridge circuit (18), is decompressed by the outdoor-side first expansion valve (73) and the outdoor-side second expansion valve (74), and then evaporates in the first outdoor heat exchanger (12*a*) and the second outdoor heat exchanger (12*b*). The evaporated refrigerant passes through the outdoor low-pressure pipe (67), flows into the accumulator (14), and is sucked into the compressor (11).

<Heating Peak Cut Operation>

Figure 8:
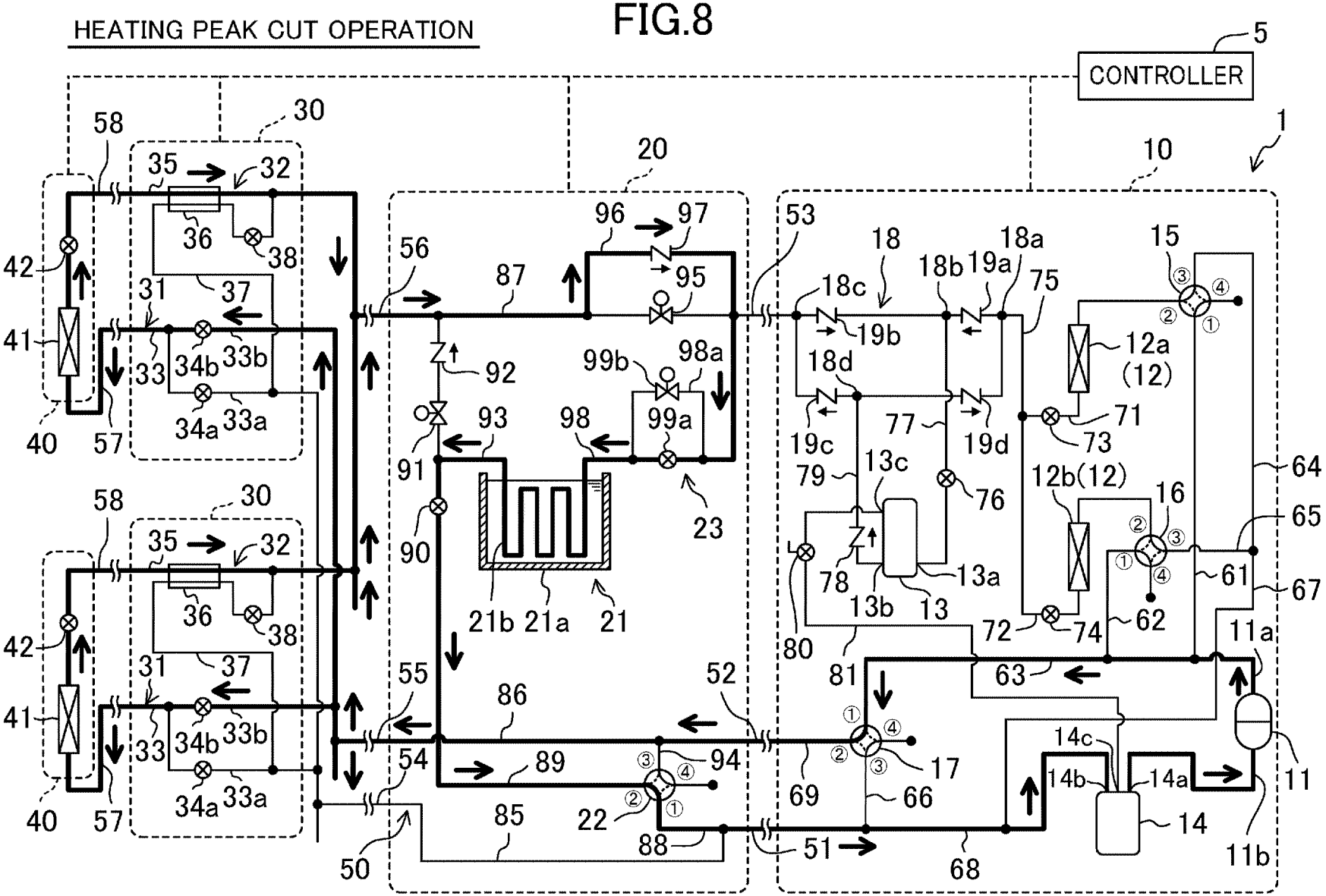
FIG. 8 is a diagram illustrating a flow of the refrigerant during a heating peak cut operation.

The heating peak cut operation shown in FIG. 8 is an operation in which the refrigerant circulates in the refrigerant circuit (50) with the indoor heat exchanger (41) serving as a radiator and the thermal storage heat exchanger (21) serving as an evaporator without use of the outdoor heat exchanger (12).

During the heating peak cut operation, the first four-way switching valve (15) and the second four-way switching valve (16) in the outdoor unit (10) are set to the second mode, and the third four-way switching valve (17) is set to the first mode. Both the outdoor-side first expansion valve (73) and the outdoor-side second expansion valve (74) are closed.

In the thermal storage unit (20), the thermal storage-side second open/close valve (95) is open, the thermal storage-side flow rate regulating valve (99*a*) is controlled to a predetermined opening degree, and the thermal storage-side third open/close valve (99*b*) is closed. The valves in the flow path switching unit (30) and the indoor unit (40) are controlled in the same manner as in the heating operation.

During the heating peak cut operation, the refrigerant that has been discharged from the compressor (11) passes through the third four-way switching valve (17) and through the thermal storage-side second gas pipe (86) of the thermal storage unit (20), then flows through the gas-side connection pipe (31) of the flow path switching unit (30), and flows into the indoor unit (40). The refrigerant dissipates heat in the indoor heat exchanger (41). Then, the condensed or cooled refrigerant flows out of the indoor unit (40), flows through the liquid-side connection pipe (32) of the flow path switching unit (30), and flows from the intermediate portion liquid communication pipe (56) into the thermal storage unit (20).

The refrigerant flows out of the thermal storage-side liquid pipe (87) of the thermal storage unit (20) and passes through the first bypass passage (96). Further, the refrigerant passes through the thermal storage-side second branch pipe (98), is decompressed by the thermal storage-side flow rate regulating valve (99*a*), absorbs heat from water stored inside the thermal storage tank (21*a*) in the thermal storage heat exchanger (21), and evaporates.

The evaporated refrigerant passes through the second connection pipe (89) and the first connection pipe (88). The refrigerant flowing in the first connection pipe (88) returns to the outdoor unit (10) through the outdoor-side first gas communication pipe (51). The refrigerant flowing in the outdoor-side first gas communication pipe (51) returns to the outdoor unit (10). The refrigerant flows from the outdoor-side first gas pipe (68) of the outdoor unit (10) into the accumulator (14), and then is sucked into the compressor (11).

<Heating/Warm Thermal Storage Operation>

Figure 9:
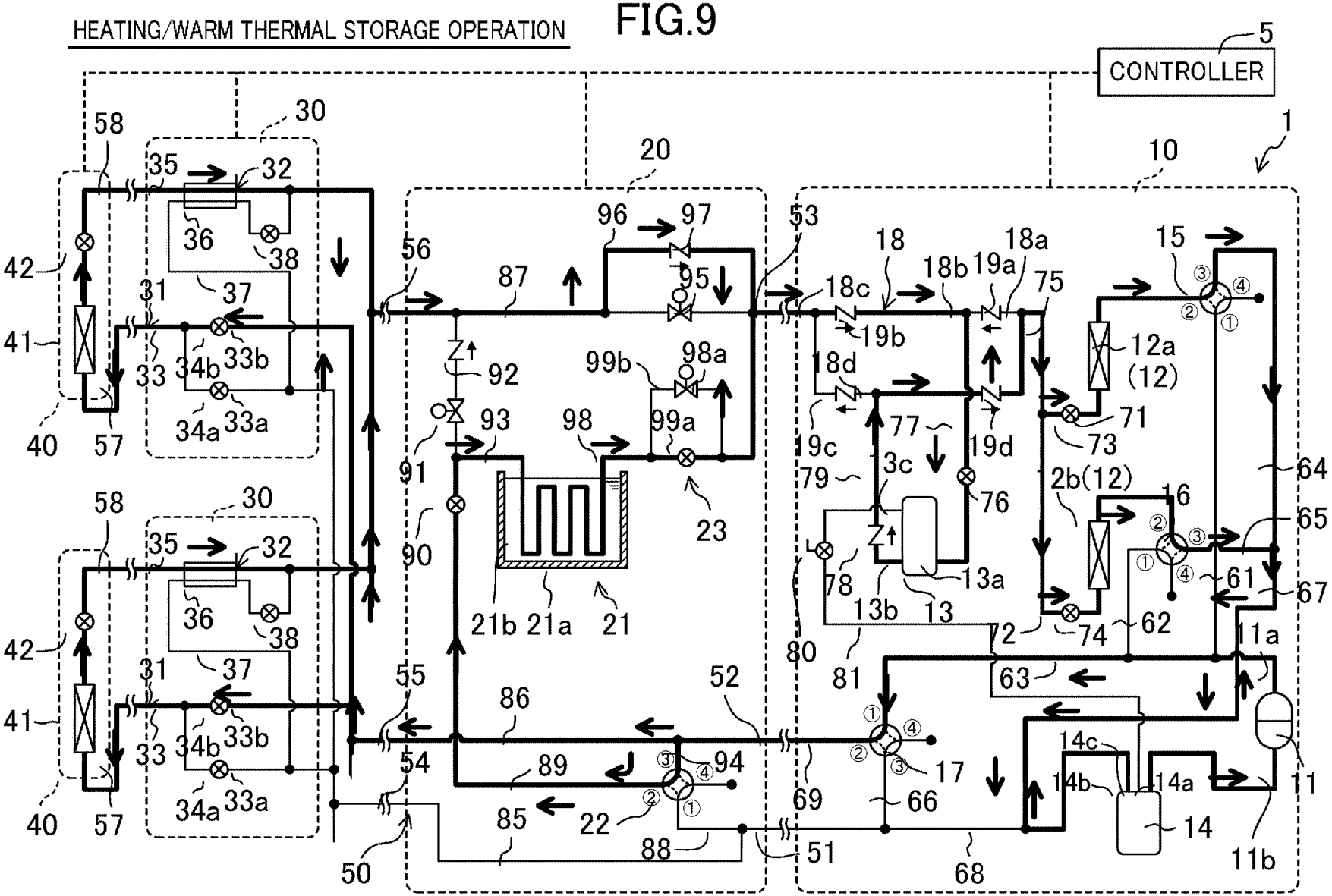
FIG. 9 is a diagram illustrating a flow of the refrigerant during a heating/warm thermal storage operation.

The heating/warm thermal storage operation shown in FIG. 9 is an operation in which water in the thermal storage tank (21*a*) in the thermal storage heat exchanger (21) is heated and warm thermal energy is stored, while the heating operation in which the refrigerant circulates in the refrigerant circuit (50) with the indoor heat exchanger (41) serving as a radiator and the outdoor heat exchanger (12) serving as an evaporator is performed.

During the heating/warm thermal storage operation, in the outdoor unit (10), the valves are controlled in the same manner as in the heating operation shown in FIG. 7. In the thermal storage unit (20), the thermal storage-side first flow rate regulating valve (90) is controlled to be fully open, and the thermal storage-side first open/close valve (91) is closed. The thermal storage-side second open/close valve (95) and the thermal storage-side third open/close valve (99*b*) are closed, and the thermal storage-side flow rate regulating valve (99*a*) is controlled to the predetermined opening degree. The valves of the flow path switching units (30) and the indoor unit (40) are controlled in the same manner as in the heating operation shown in FIG. 7.

During the heating/warm thermal storage operation, the refrigerant that has been discharged from the compressor (11) passes through the third four-way switching valve (17) and the thermal storage-side second gas pipe (86) of the thermal storage unit (20). A part of the refrigerant branches from the fourth four-way switching valve (22) into the second connection pipe (89), and the remaining part of the refrigerant passes through the gas-side connection pipe (31) of the flow path switching unit (30) and flows into the indoor unit (40). The refrigerant dissipates heat in the indoor heat exchanger (41). Then, the condensed or cooled refrigerant flows out of the indoor unit (40), through the liquid-side connection pipe (32) of the flow path switching unit (30), and flows from the intermediate portion liquid communication pipe (56) into the thermal storage unit (20). The refrigerant flows out of the thermal storage-side liquid pipe (87) of the thermal storage unit (20) and flows through the first bypass passage (96).

The refrigerant that has branched from the thermal storage-side second gas pipe (86) through the fourth four-way switching valve (22) into the second connection pipe (89) flows into the thermal storage heat exchanger (21) and dissipates heat into the water in the thermal storage tank (21*a*), and heats the water so that the warm thermal energy may be stored. The refrigerant that has dissipated heat in the thermal storage heat exchanger (21) flows into the thermal storage-side liquid pipe (87) through the thermal storage-side second branch pipe (98), in the thermal storage-side liquid pipe (87), merges with the refrigerant that flowed through the first bypass passage (96), and then flows from the outdoor-side liquid communication pipe (53) into the outdoor unit (10).

The refrigerant that has flowed into the outdoor unit (10) flows into the receiver (13) through the refrigerant introduction pipe (77), and then flows out to the liquid outflow pipe (79). The refrigerant passes through the bridge circuit (18) to pass through the outdoor-side first expansion valve (73) and the outdoor-side second expansion valve (74), and then evaporates in the first outdoor heat exchanger (12*a*) and the second outdoor heat exchanger (12*b*). The evaporated refrigerant passes through the outdoor low-pressure pipe (67), flows into the accumulator (14), and is sucked into the compressor (11).

<Warm Thermal Storage Operation>

Figure 10:
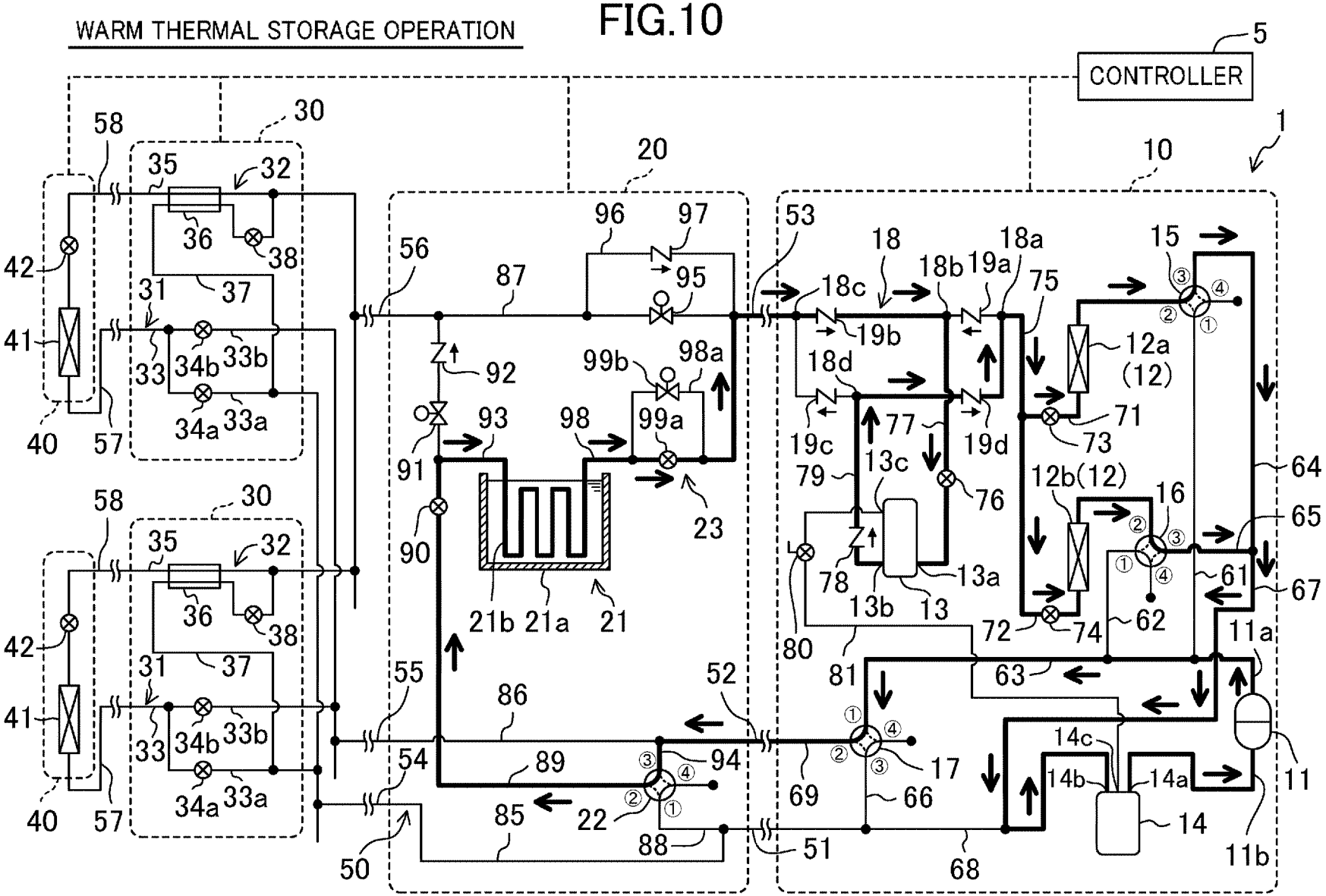
FIG. 10 is a diagram illustrating a flow of the refrigerant during a warm thermal storage operation.

The warm thermal storage operation shown in FIG. 10 is an operation in which the refrigerant circulates in the refrigerant circuit (50) and the warm thermal energy is stored in the thermal storage heat exchanger with the thermal storage heat exchanger serving as a radiator and the outdoor heat exchanger (12) serving as an evaporator without use of the indoor heat exchanger (41).

During the warm thermal storage operation, in the outdoor unit (10), the valves are controlled in the same manner as in the heating operation shown in FIG. 7. In the thermal storage unit (20), the thermal storage-side first flow rate regulating valve (90) is controlled to be fully open, and the thermal storage-side first open/close valve (91) is closed. The thermal storage-side second open/close valve (95) and the thermal storage-side third open/close valve (99*b*) are closed, and the thermal storage-side flow rate regulating valve (99*a*) is controlled to the predetermined opening degree. In the flow path switching unit (30) and the indoor unit (40), at least one of the first flow path switching valve (34*a*) or the outdoor expansion valve is closed, and the flow of the refrigerant in the indoor heat exchanger (41) is blocked.

During the warm thermal storage operation, the refrigerant that has been discharged from the compressor (11) passes through the third four-way switching valve (17) and the thermal storage-side second gas pipe (86) of the thermal storage unit (20), then branches from the fourth four-way switching valve (22) into the second connection pipe (89). The refrigerant flows into the thermal storage heat exchanger (21) and dissipates heat into the water in the thermal storage tank (21*a*), and heats the water so that the warm thermal energy may be stored. The refrigerant that has dissipated heat in the thermal storage heat exchanger (21) flows into the thermal storage-side liquid pipe (87) through the thermal storage-side second branch pipe (98), and then flows from the outdoor-side liquid communication pipe (53) into the outdoor unit (10).

The refrigerant that has flowed into the outdoor unit (10) flows into the receiver (13) through the refrigerant introduction pipe (77), and then flows out to the liquid outflow pipe (79). The refrigerant passes through the bridge circuit (18) and through the outdoor-side first expansion valve (73) and the outdoor-side second expansion valve (74). Then, the refrigerant evaporates in the first outdoor heat exchanger (12*a*) and the second outdoor heat exchanger (12*b*). The evaporated refrigerant passes through the outdoor low-pressure pipe (67), flows into the accumulator (14), and is sucked into the compressor (11).

—Advantages of First Embodiment—

In the air-conditioning system (1) including the thermal storage heat exchanger (21), depending on the operational mode of the refrigerant circuit (50), the liquid refrigerant may be accumulated in a heat transfer tube (21*b*) of the thermal storage heat exchanger (21). When the operation is switched from this mode to the operation reducing the power consumption for cooling, it may be impossible for the thermal storage heat exchanger (21) to achieve its original heat exchange capacity as a radiator until the liquid refrigerant is pushed out from the heat transfer tube (21*b*). In such a case, it is not possible to quickly respond to a power consumption-reducing operation.

In the present embodiment, the outdoor flow rate regulating valve (76) opening and closing the refrigerant introduction pipe (77) connected between the thermal storage heat exchanger (21) and the receiver (13) (between the outdoor-side liquid pipe (75) and the receiver (13)) is provided. Consequently, when the operational mode is switched to the cooling peak cut operation, even if the liquid refrigerant is accumulated in the thermal storage heat exchanger (21), the liquid refrigerant in the thermal storage heat exchanger (21) is introduced into the receiver (13), by opening the outdoor flow rate regulating valve (76), and time required to push the liquid refrigerant out of the thermal storage heat exchanger (21) is shortened. Thus, the thermal storage heat exchanger (21) may quickly achieve its original heat exchange capacity as a radiator, it is possible to quickly respond to the cooling peak cut operation performing the refrigeration cycle in which the difference between high and low pressure in the refrigerant circuit is small to quickly reduce the power consumption.

In the present embodiment, the venting pipe (81) is connected to the receiver (13) to release the gas refrigerant inside the receiver (13). The venting pipe (81) is provided with the venting valve (80). Further, the venting pipe (81) is connected to the low-pressure pipe (68, 11*b*) of the refrigerant circuit (50) in the cooling peak cut operation. Consequently, during the cooling peak cut operation, opening the venting valve (80) allows to reduce an excessive increase in the pressure in the receiver (13), and promotes introducing the liquid refrigerant from the thermal storage heat exchanger (21) to the receiver (13). Thus, a quick shift to the cooling peak cut operation in which the power consumption is low may be implemented with a simple configuration.

In this way, in the present embodiment, during the cooling peak cut operation, the liquid refrigerant accumulated in the thermal storage heat exchanger (21) is introduced into the receiver (13). Consequently, a quick shift to the cooling operation in which the power consumption is low may be performed by using the receiver (13) that is generally provided to the refrigerant circuit (50), even if a dedicated refrigerant container is not provided.

In the present embodiment, during the cooling peak cut operation, the pressure of the refrigerant in the thermal storage heat exchanger (21) may be set to a target value by adjusting the opening degree of the outdoor flow rate regulating valve (76) and the venting valve (80). The cooling peak cut operation is an operation in which the high pressure of the refrigerant is lower than that during the normal cooling operation, as described above. In the present embodiment, since the configuration makes it possible to adjust the high pressure of the refrigerant in the outdoor flow rate regulating valve (76), the input of the compressor (11) is reduced, and thus the power consumption may be reduced. Further, adjusting the high pressure of the refrigerant enables the input of the compressor that affects the coefficient of performance (COP) to be freely adjusted, thus facilitating the operation control.

Further, in the present embodiment, the degree of subcooling of the refrigerant in the thermal storage heat exchanger (21) may be adjusted by adjusting an opening degree of the outdoor-side flow rate control valve (76) and the venting valve (80) during the cooling peak cut operation. A degree of subcooling of the refrigerant in the thermal storage heat exchanger (21) may be adjusted and the cooling capacity may be adjusted. That is, adjusting the degree of subcooling of the refrigerant in the thermal storage heat exchanger (21) enables the enthalpy difference in the P-h diagram shown in FIG. 11 to be adjusted. Thus, an operation in which the COP is high may be performed by enlarging the enthalpy difference.

In general, if the liquid refrigerant accumulated in the thermal storage heat exchanger (21) flows in a large amount into the indoor heat exchanger (41) in the indoor space when the operational mode was switched to the cooling peak cut operation, capacity fluctuations or sounds and vibrations may occur. The present embodiment has a configuration in which the liquid refrigerant accumulated in the thermal storage heat exchanger (21) is released to the receiver (13) when the operational mode was switched to the cooling peak cut operation. Thus, the refrigerant does not flow in a large amount into the indoor heat exchanger (41). Consequently, capacity fluctuations or sounds and vibrations may be reduced, as well.

Further, since the liquid refrigerant accumulated in the thermal storage heat exchanger (21) is introduced to the refrigerant container (receiver (13)), the liquid refrigerant is prevented from returning directly to the compressor (11). Therefore, the reliability of the compressor (11) may be secured and the quick shift into the cooling peak cut operation (first cooling operation) having low power consumption may be achieved.

—Variations of First Embodiment—

(First Variation)

Figure 12:
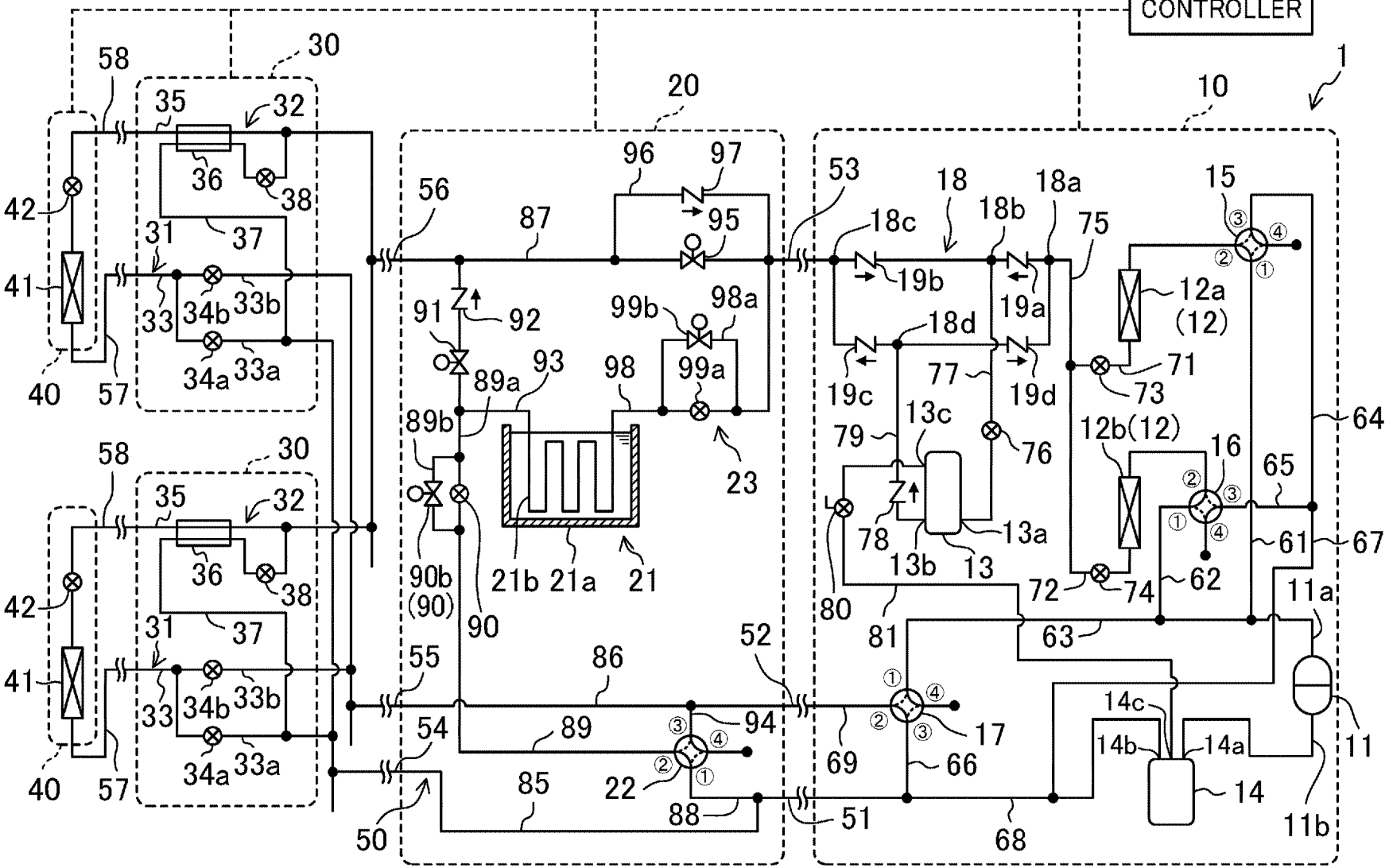
FIG. 12 is a piping system diagram illustrating a refrigerant circuit of an air-conditioning system according to a first variation of the first embodiment.

In the first embodiment, only the thermal storage-side first flow rate regulating valve (90) is used as a variable throttle mechanism. However, as shown in FIG. 12, a part of the second connection pipe (communication passage) (89) may branch into a first pipe (main pipe) (89*a*) and a second pipe (bypass pipe) (89*b*) connected in parallel to each other. The first pipe (89*a*) may be provided with a thermal storage-side first flow rate regulating valve (90) being a variable throttle valve in which an opening degree may be adjusted. The second pipe (89*b*) may be provided with an open/close valve (90*b*) that may be set to be fully closed or fully open. The thermal storage-side first flow rate regulating valve (90) and the open/close valve (90*b*) may constitute a variable throttle mechanism.

In the configuration of the first variation, when the variable throttle mechanism is fully open, the pressure loss in the refrigerant may be reduced as compared to the first embodiment by using the open/close valve (90*b*). Therefore, an efficient operation with lower power consumption may be implemented.

(Second Variation)

Figure 13:
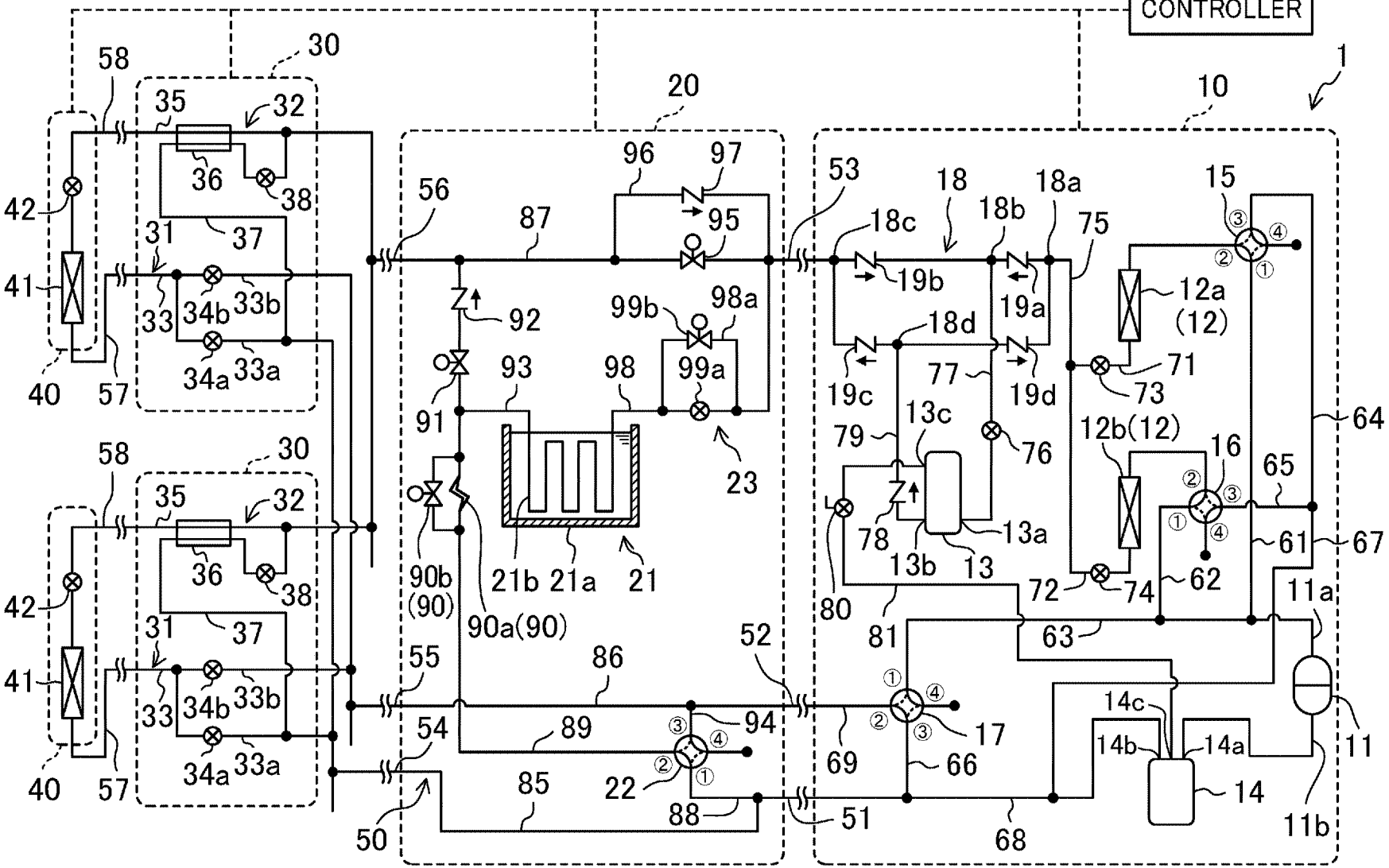
FIG. 13 is a piping system diagram illustrating a refrigerant circuit of an air-conditioning system according to a second variation of the first embodiment.

In the first variation, the thermal storage-side first flow rate regulating valve (90) and the open/close valve (90*b*) constitute the variable throttle mechanism. However, as shown in FIG. 13, a capillary tube (90*a*) being a fixed throttle mechanism may be provided instead of the thermal storage-side first flow rate regulating valve (90), and the capillary tube (90*a*) and the open/close valve (90*b*) may constitute the variable throttle mechanism.

In the second variation, the variable throttle mechanism that may be set to the fully open position, fully closed position, or intermediate position being between the fully open position and the fully closed position may be implemented with a simple configuration.

Second Embodiment

Figure 14:
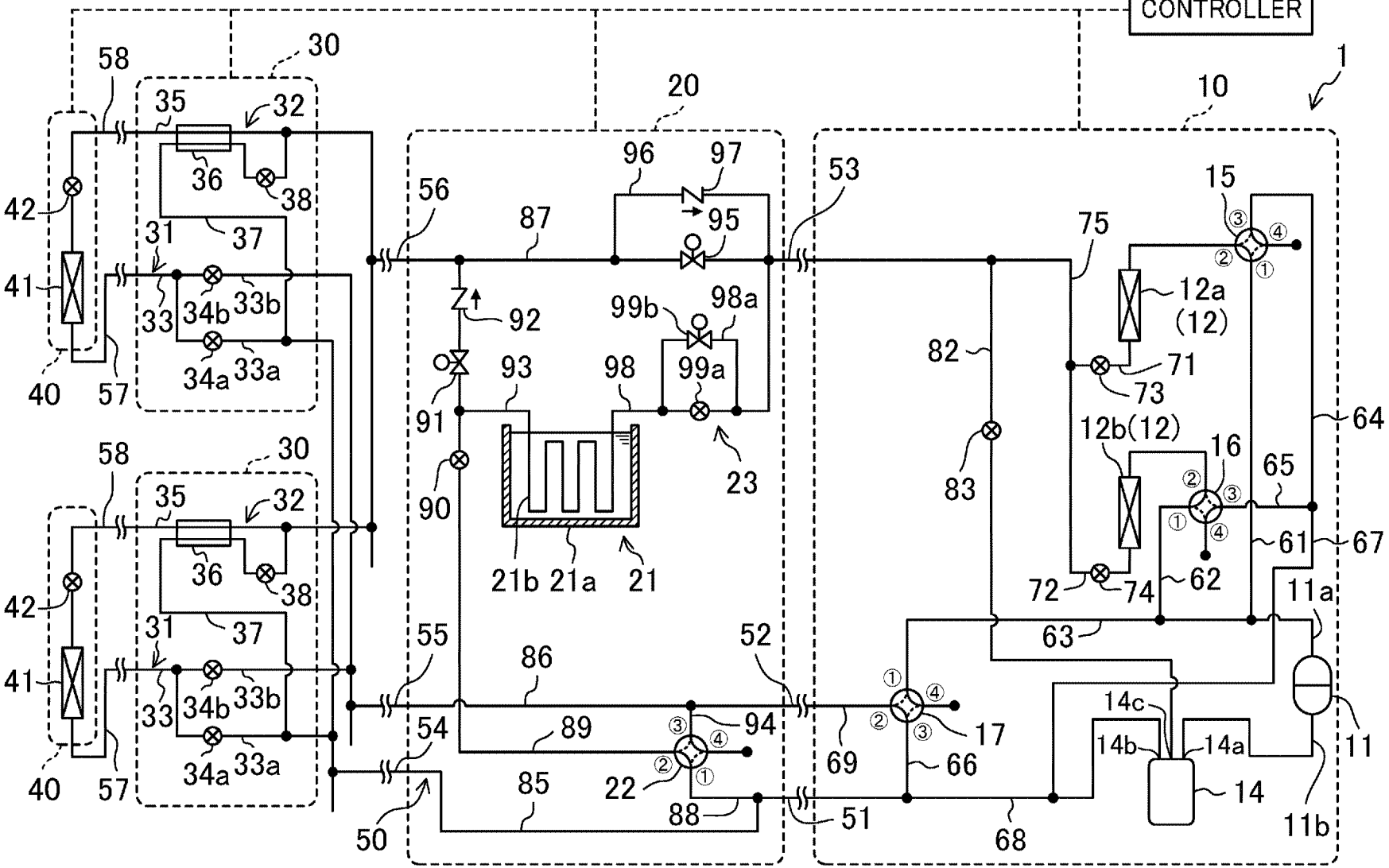
FIG. 14 is a piping system diagram illustrating a refrigerant circuit of an air-conditioning system according to a second embodiment.

A second embodiment shown in FIG. 14 will be described below.

In the second embodiment, the receiver (13) and the bridge circuit (18) are not provided in the refrigerant circuit (50). In the second embodiment, during the cooling peak cut operation, the accumulator (14) is provided to an intermediate portion of the low-pressure pipe of the refrigerant circuit (50), and is set as a refrigerant container into which the liquid refrigerant from the thermal storage heat exchanger (21) is introduced. Therefore, when the operational mode of the refrigerant circuit is switched to the cooling peak cut operation, the indoor heat exchanger (41) and the accumulator (14) are connected in parallel with respect to the thermal storage heat exchanger (21).

One end of a refrigerant introduction pipe (82) to which a motor-operated valve (first opening/closing mechanism) (83) whose opening degree is adjustable is connected to the outdoor-side liquid pipe (75). Another end of the refrigerant introduction pipe (82) is connected to the second gas inflow port (14*c*) of the accumulator (14).

The other components of the refrigerant circuit (50) of the second embodiment are configured just like those of the refrigerant circuit (50) of the first embodiment.

In the second embodiment, when the operational mode is switched to the cooling peak cut operation, the refrigerant accumulated in the heat transfer tube (21*b*) of the thermal storage heat exchanger (21) passes through the refrigerant introduction pipe (82), is decompressed by the electric valve (83), and flows into the accumulator (14).

In the second embodiment, the opening degree of the electric valve (83) is appropriately controlled. This reduces flow of a part of the refrigerant that has flowed out of the thermal storage heat exchanger (21) into the accumulator (14) that is used as a refrigerant container to substantially prevent the refrigerant from flowing in a large amount into the indoor heat exchanger (41).

On the contrary, in a case the refrigerant container is not used during the cooling peak cut operation, the pressure of the refrigerant in the liquid pipe flowing from the thermal storage heat exchanger (21) to the indoor heat exchanger (41) increases, and despite the cooling peak cut operation process being performed, it may be impossible to quickly shift to the cooling peak cut operation. In the present embodiment, the increase in the high pressure is reduced by reducing the flow rate of the refrigerant flowing from the thermal storage heat exchanger (21) to the indoor heat exchanger (41). Thus, during the cooling peak cut operation, the difference between the high and low pressure is small and it is possible to quickly respond to the operation in which the power consumption of the compressor (11) is low and the COP is high.

Further, in the second embodiment as well, the thermal storage-side first flow rate regulating valve (90) is set to the predetermined opening degree during the cooling operation. Therefore, during an operation other than the cooling operation, the liquid refrigerant remaining in the heat transfer tube (21*b*) of the thermal storage heat exchanger (21) is decompressed, and the refrigerant flows through the second connection pipe (89) and the first connection pipe (88) into the thermal storage-side first gas pipe (85) that is a low-pressure pipe during the cooling operation. Consequently, when the cooling operation is switched to the cooling peak cut operation, the thermal storage heat exchanger (21) immediately achieves the heat exchange capacity (functions as a radiator). In this way, in the second embodiment, just like in the first embodiment, controlling the opening degree of the thermal storage-side first flow rate regulating valve (90) during the cooling operation enables a quick shift to the cooling peak cut operation in which the power consumption is low.

In this way, in the present embodiment, during the cooling peak cut operation, the liquid refrigerant accumulated in the thermal storage heat exchanger (21) is introduced into the accumulator (14). Consequently, a quick shift to the cooling operation in which the power consumption is low may be performed by using the accumulator (14) generally provided to the refrigerant circuit (50), even if a dedicated refrigerant container is not provided.

Other Embodiments

The above embodiment may also have the following configurations.

In the above embodiments, the thermal storage heat exchanger (21) is of a static type in which ice is generated around the heat transfer tube (21*b*) inside the thermal storage tank (21*a*). However, a dynamic-type thermal storage heat exchanger (21) circulating a thermal storage medium such as water inside the thermal storage tank (21*a*) between a thermal storage tank (21*a*) and a plate heat exchanger (not shown) to exchange heat between the thermal storage medium and the refrigerant in the plate heat exchanger may be used. The plate heat exchanger is merely an example and its model can be changed as long as the thermal storage medium and the refrigerant exchange heat with each other.

In the above embodiment, water is given as an example of the thermal storage medium, but another thermal storage medium may be used.

In the above embodiment, the refrigerant circuit (50) of the air-conditioning system (1) capable of performing a cooling operation and a heating operation at the same time is provided with the thermal storage heat exchanger (21). However, the refrigerant circuit of the air-conditioning system (1) may be any circuit switching between all modes in which all of the plurality of indoor units (40) perform a cooling operation, and all modes in which all of the plurality of indoor units (40) perform a heating operation. Further, the air-conditioning system of the present disclosure may be also a system that switches, e.g., the normal cooling operation, the cooling peak cut operation, and the cold thermal storage operation, and that does not perform a heating operation.

While the embodiments and variations thereof have been described above, various changes in form and details may be made without departing from the spirit and scope of the claims. The embodiments and the variations thereof may be combined and replaced with each other without deteriorating intended functions of the present disclosure.

INDUSTRIAL APPLICABILITY

As described above, the present disclosure is useful for an air-conditioning system.

EXPLANATION OF REFERENCES

1 Air-conditioning System
5 Controller (Control Unit)
11*b* Suction Pipe (Low-Pressure Pipe)
13 Receiver (Refrigerant Container)
14 Accumulator (Refrigerant Container)
21 Thermal Storage Heat Exchanger
41 Indoor Heat Exchanger
50 Refrigerant Circuit
68 Outdoor-side First Gas Pipe (Low-pressure Pipe)
76 Outdoor Flow Rate Regulating Valve (First Opening/Closing Mechanism)
77 Refrigerant Introduction Pipe
80 Venting Valve (Second Opening/Closing Mechanism)
81 Gas Outflow Pipe (Venting Pipe)
82 Refrigerant Introduction Pipe
83 Outdoor Flow Rate Regulating Valve (First Opening/Closing Mechanism)

The invention claimed is:

1. An air-conditioning system having a refrigerant circuit to which a thermal storage heat exchanger is connected, the air-conditioning system comprising:

a refrigerant container capable of introducing a liquid refrigerant, wherein the refrigerant circuit is configured such that the refrigerant container and an indoor heat exchanger of the refrigerant circuit are connected in parallel with respect to the thermal storage heat exchanger when an operational mode is switched to a first cooling operation in which the thermal storage heat exchanger serves as a radiator and the indoor heat exchanger serves as an evaporator, such that parts of the refrigerant flowing out of the thermal storage heat exchanger dividedly flow into the refrigerant container and the indoor heat exchanger, respectively.

2. The air-conditioning system of claim 1, further comprising a first valve configured to open and close a refrigerant introduction pipe connected to the thermal storage heat exchanger and the refrigerant container.

3. The air-conditioning system of claim 1, further comprising a first valve configured to open and close a refrigerant introduction pipe connected to the thermal storage heat exchanger and the refrigerant container, wherein the refrigerant container includes a venting pipe releasing a gas refrigerant out of the refrigerant container, and in the first cooling operation, the venting pipe is connected to a low-pressure pipe of the refrigerant circuit via a second valve.

4. The air-conditioning system of claim 2, further comprising a control unit configured to adjust the valve so as to open the first valve when the operational mode is switched to the first cooling operation.

5. The air-conditioning system of claim 3, further comprising a control unit configured to adjust only the first valve so as to open the first valve, or adjust both the first valve and the second valve so as to open both the first valve and the second valve when the operational mode is switched to the first cooling operation.

6. The air-conditioning system of claim 4, wherein the first valve has an opening degree that is adjustable, and the control unit is configured to control the opening degree of the first valve such that a pressure of a refrigerant in the thermal storage heat exchanger reaches a target value.

7. The air-conditioning system of claim 4, wherein the first valve has an opening degree that is adjustable, and the control unit is configured to control the opening degree of the first valve such that a degree of subcooling of a refrigerant on an outlet side of the thermal storage heat exchanger reaches a target value.

8. The air-conditioning system of claim 5, wherein at least one of the first valve and the second valve has an opening degree that is adjustable, and the control unit is configured to control the opening degree of the at least one of the first valve and the second valve such that a pressure of a refrigerant in the thermal storage heat exchanger reaches a target value.

9. The air-conditioning system of claim 5, wherein at least one of the first valve and the second valve has an opening degree that is adjustable, and the control unit is configured to control the opening degree of the at least one of the first valve and the second valve such that a degree of subcooling of a refrigerant on an outlet side of the thermal storage heat exchanger reaches a target value.

10. The air-conditioning system of claim 1, wherein the refrigerant circuit includes a receiver connected to an intermediate portion of a high-pressure liquid pipe of the refrigerant circuit, and the receiver serves as the refrigerant container.

11. The air-conditioning system of claim 1, wherein the refrigerant circuit includes an accumulator connected to an intermediate portion of a low-pressure gas pipe of the refrigerant circuit, and the accumulator serves as the refrigerant container.

12. The air-conditioning system of claim 2, wherein the refrigerant circuit includes a receiver connected to an intermediate portion of a high-pressure liquid pipe of the refrigerant circuit, and the receiver serves as the refrigerant container.

13. The air-conditioning system of claim 3, wherein the refrigerant circuit includes a receiver connected to an intermediate portion of a high-pressure liquid pipe of the refrigerant circuit, and the receiver serves as the refrigerant container.

14. The air-conditioning system of claim 4, wherein the refrigerant circuit includes a receiver connected to an intermediate portion of a high-pressure liquid pipe of the refrigerant circuit, and the receiver serves as the refrigerant container.

15. The air-conditioning system of claim 5, wherein the refrigerant circuit includes a receiver connected to an intermediate portion of a high-pressure liquid pipe of the refrigerant circuit, and the receiver serves as the refrigerant container.

16. The air-conditioning system of claim 6, wherein the refrigerant circuit includes a receiver connected to an intermediate portion of a high-pressure liquid pipe of the refrigerant circuit, and the receiver serves as the refrigerant container.

17. The air-conditioning system of claim 7, wherein the refrigerant circuit includes a receiver connected to an intermediate portion of a high-pressure liquid pipe of the refrigerant circuit, and the receiver serves as the refrigerant container.

18. The air-conditioning system of claim 2, wherein the refrigerant circuit includes an accumulator connected to an intermediate portion of a low-pressure gas pipe of the refrigerant circuit, and the accumulator serves as the refrigerant container.

19. The air-conditioning system of claim 3, wherein the refrigerant circuit includes an accumulator connected to an intermediate portion of a low-pressure gas pipe of the refrigerant circuit, and the accumulator serves as the refrigerant container.

20. The air-conditioning system of claim 4, wherein the refrigerant circuit includes an accumulator connected to an intermediate portion of a low-pressure gas pipe of the refrigerant circuit, and the accumulator serves as the refrigerant container.

* * * * *